US008528787B2

(12) United States Patent
Cittadino et al.

(10) Patent No.: US 8,528,787 B2
(45) **Date of Patent: *Sep. 10, 2013**

(54) INTERCHANGABLE ACCESS DEVICE FOR A DISPENSER

(75) Inventors: Antonio M. Cittadino, Appleton, WI (US); William R. Mathias, Middleton, WI (US); Alan P. Paal, New Franken, WI (US)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/162,368

(22) Filed: Jun. 16, 2011

(65) Prior Publication Data

US 2011/0303699 A1 Dec. 15, 2011

Related U.S. Application Data

(63) Continuation-in-part of application No. 12/237,844, filed on Sep. 25, 2008, now Pat. No. 7,984,829.

(51) Int. Cl.
*B67B 1/00* (2006.01)

(52) U.S. Cl.
USPC ..... 222/153.03; 222/153.01; 222/153.09; 222/181.1; 222/181.3

(58) Field of Classification Search
USPC ..... 222/153.02, 153.03, 153.09, 180, 222/181.1, 181.3, 160, 173, 153.01
See application file for complete search history.

(56) References Cited

U.S. PATENT DOCUMENTS

| | | | | |
|---|---|---|---|---|
| 3,540,630 | A | | 11/1970 | Brown et al. |
| 4,391,111 | A | | 7/1983 | Marcy |
| 4,493,440 | A | | 1/1985 | von Buelow et al. |
| 5,183,182 | A | | 2/1993 | Comstock et al. |
| 5,253,786 | A | | 10/1993 | Schmidt |
| 5,413,251 | A | * | 5/1995 | Adamson ..... 222/129 |
| 5,452,825 | A | * | 9/1995 | Comstock et al. ..... 222/135 |
| 6,131,773 | A | | 10/2000 | Wade et al. |

(Continued)

FOREIGN PATENT DOCUMENTS

| | | | |
|---|---|---|---|
| EP | 1702547 | A2 | 9/2006 |
| JP | 3100367 | U | 12/2003 |
| KR | 200171448 | Y1 | 4/2000 |
| KR | 200309198 | Y1 | 3/2003 |

OTHER PUBLICATIONS

Partial Machine Translation of JP 3100367 U; Printed Jun. 28, 2010; 8 pgs.

(Continued)

*Primary Examiner* — Frederick C Nicolas
(74) *Attorney, Agent, or Firm* — Deborah K. Butler

(57) ABSTRACT

A dispenser includes a back-housing, a cover movably coupled to the back-housing, and a latch coupled to the back-housing. A catch is coupled to the cover. The latch cooperates with the catch to hold the cover against the back-housing when the cover is in a first position. The cover has an opening. A key insert is disposed to be removably coupled to the opening of the cover. A push button insert is disposed to be removably coupled to the key insert. A key device is disposed to be removably coupled to the key insert. The push button insert and the key device are mutually interchangeable with each other for being removably coupled to the key insert by a user.

20 Claims, 20 Drawing Sheets

(56) References Cited

U.S. PATENT DOCUMENTS

| | | | | |
|---|---|---|---|---|
| 6,209,184 | B1 | 4/2001 | Copeland et al. | |
| 6,772,916 | B1 | 8/2004 | Reynolds | |
| 6,903,654 | B2 | 6/2005 | Hansen et al. | |
| 7,040,566 | B1 | 5/2006 | Rodrian et al. | |
| 7,051,987 | B2 | 5/2006 | Chen | |
| 7,086,567 | B1 * | 8/2006 | Ciavarella et al. | 222/95 |
| 7,232,045 | B2 | 6/2007 | Ophardt et al. | |
| 7,654,417 | B2 * | 2/2010 | Rhodenbaugh et al. | 222/153.03 |
| 7,984,829 | B2 * | 7/2011 | Cittadino et al. | 222/153.03 |

OTHER PUBLICATIONS

PCT International Search Report and Written Opinion for International Application No. PCT/US2009/056173; International Filing Date: Sep. 8, 2009; 7 pgs.

* cited by examiner

INTERCHANGABLE ACCESS DEVICE FOR A DISPENSER

CROSS REFERENCE TO RELATED APPLICATIONS

This application is a continuation-in-part application of U.S. application Ser. No. 12/237,844, filed Sep. 25, 2008, which is hereby incorporated by reference in its entirety.

BACKGROUND OF THE INVENTION

The present invention relates generally to a dispenser, and in particular to a dispenser that provides an interchangeable access feature to different levels of security to prevent unauthorized access to product within the dispenser.

Dispensing equipment is used in a wide variety of applications, such as in the delivery of soap or sheet product for example. Dispensers are used in self-service types of environments where a product is needed and it is uneconomical or undesirable to have a full time attendant. Typically, a user activates the dispenser and an internal mechanism accesses a supply of the product. The product is removed from the internal supply and provided to the user. Since the internal supply is not unlimited, dispensers usually include some type of cover or door that allows an operator to access the internal area of a dispenser, such as for maintenance tasks or restocking of product for example.

In some environments, it is desirable to secure the cover of the dispenser with a lock. The locking of the dispenser prevents unauthorized access that discourages theft of product and vandalism of the dispenser. However, the use of a lock increases the amount of time it takes for the operator to restock the dispenser. The lock may further create a logistical issue for the operator in making sure that maintenance personnel with the correct keys are dispatched to appropriate locations to prevent losing time if the maintenance personnel are unable to open the dispenser. To avoid this situation, operators in environments with less exposure to vandalism and theft typically install dispensers without locks. This unsecured cover is held closed by a simple catch arrangement. Unfortunately, this results in manufacturers and installers of dispensers having to fabricate and stock multiple models or stock keeping units (SKU's) of dispensers in order to meet the needs of end customers.

While existing dispensers are suitable for their intended purposes, there still remains a need for improvements, particularly regarding the access mechanisms for restocking the dispenser and the reduction of manufacturing costs through the use of interchangeable parts.

SUMMARY OF THE INVENTION

A dispenser is provided having a back-housing. A catch is coupled to the back-housing. A cover is movably coupled to the back-housing, the cover having a first opening. A latch is coupled to the cover, where the latch cooperates with the catch to hold the cover against the back-housing when the cover is in a first position. A push button lock is disposed to be removably coupled to the first opening. A keyed device is disposed to be removably coupled to the first opening, wherein the push button lock and the keyed device are mutually interchangeable with each other for being removably coupled to the first opening by a user.

A dispenser is also provided having a back-housing with a first end and a second end. The back-housing includes a catch adjacent the first end. A cover has a first opening adjacent a third end, and a fourth end opposite the third end. The cover fourth end is coupled for rotation to the back-housing second end, wherein the cover is movable between a first position and a second position. A latch member is coupled to the cover. The latch member is removably coupled to the catch when the cover is in the first position. An interchangeable access device is provided having a tab. The tab is sized to allow the access device to be removably coupled to the cover in the first opening and operably coupled to the latch, wherein the access device is user selectable between a push-button device or a keyed device.

A dispenser kit is also provided having a back-housing that includes a catch. A cover is rotatably coupled to the back-housing at a first end, the cover movable between a first and second position and having a first opening. A latch is coupled to the cover adjacent the first opening and positioned to engage the catch when the cover is in the first position. A first access device is sized to movably fit in the first opening, the first access device being movable between a third position and a fourth position when positioned in the first opening. A second access device is sized to fit in the opening with a snap-fit; the second access device includes a second opening. The first access device and the second access device are mutually interchangeable with each other for being positioned in the first opening and the first access device and the second access device each cooperate with the latch to disengage the latch from the catch.

A dispenser is disclosed having a back-housing, a cover movably coupled to the back-housing, and a latch coupled to the back-housing. A catch is coupled to the cover. The latch cooperates with the catch to hold the cover against the back-housing when the cover is in a first position. The cover has an opening. A key insert is disposed to be removably coupled to the opening of the cover. A push button insert is disposed to be removably coupled to the key insert. A key device is disposed to be removably coupled to the key insert. The push button insert and the key device are mutually interchangeable with each other for being removably coupled to the key insert by a user.

A dispenser is disclosed having a back-housing, a cover movably coupled to the back-housing, and a latch coupled to the back-housing. A catch is coupled to the cover. The latch cooperates with the catch to hold the cover against the back-housing when the cover is in a first position. The cover has an opening. The dispenser is configured to receive at least one of: a key insert disposed to be removably coupled to the opening of the cover; a push button insert disposed to be removably coupled to the key insert; a twist insert disposed to be removably coupled to the opening of the cover; and, a keyed twist insert disposed to be removably coupled to the opening of the cover. The dispenser is also configured to receive a key device disposed to be removably coupled to the key insert and the keyed twist insert. The push button insert and the key device when present are mutually interchangeable with each other for being removably coupled to the key insert by a user. The twist insert and the keyed twist insert when present are mutually interchangeable with each other for being removably coupled to the cover.

A dispenser is disclosed having a back-housing with an opening, a latch coupled to the back-housing, a cover movably coupled to the back-housing, and a catch coupled to the cover. The latch cooperates with the catch to hold the cover against the back-housing when the cover is in a first position. A key insert is disposed to be removably coupled to the opening of the back-housing. A push button insert is disposed to be removably coupled to the key insert. A key device is disposed to be removably coupled to the key insert. The push button insert and the key device are mutually interchangeable with each other for being removably coupled to the key insert by a user.

BRIEF DESCRIPTION OF THE DRAWINGS

Referring now to the drawings, which are meant to be exemplary and not limiting, and wherein like elements are numbered alike.

DETAILED DESCRIPTION

Figure 1:
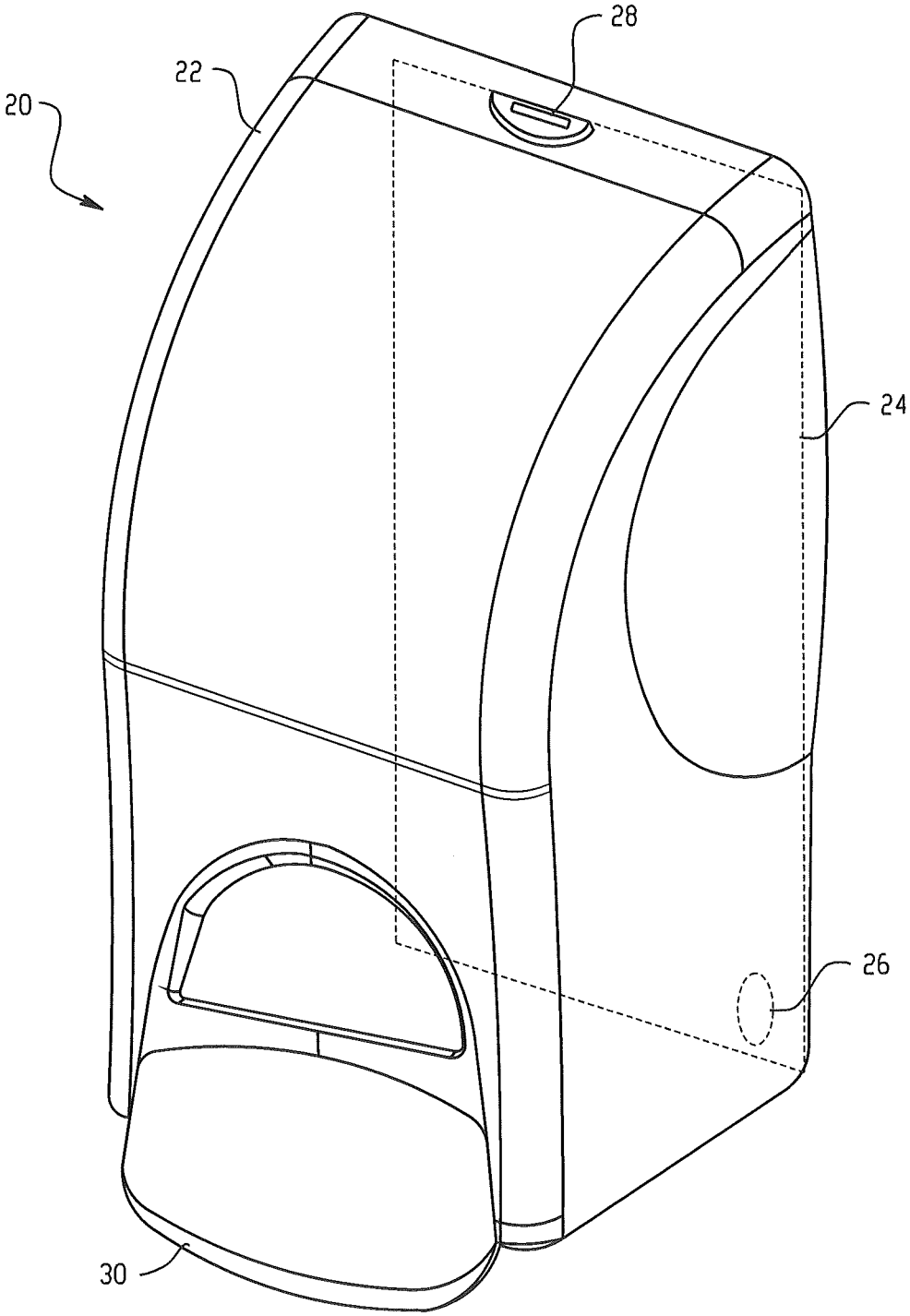
FIG. 1 is a perspective view illustration of a dispenser in accordance with an embodiment of the invention.

FIG. 1 illustrates an exemplary embodiment of a dispenser 20. The dispenser 20 may be any type of dispenser that provides a product when activated by a user. As such, the dispenser 20 may be a soap dispenser, a liquid soap dispenser, a foam dispenser or a sheet product dispenser for example. While reference may be made to soap or liquid soap, it will be appreciated that the scope of the invention is not so limited, and extends to other flowable products, such as liquid, foam, gel, lotion, detergent, or any other flowable product capable of being pumped from a dispenser, for example. Further, the term "sheet products" as used herein is inclusive of natural and/or synthetic cloth or paper sheets. Sheet products may include both woven and non-woven articles. There are a wide variety of nonwoven processes and they can be either wetlaid or drylaid. Some examples include hydroentagled (sometimes called spunlace), double re-creped (DRC), airlaid, spunbond, carded, paper towel, and meltblown sheet products. Further, sheet products may contain fibrous cellulosic materials that may be derived from natural sources, such as wood pulp fibers, as well as other fibrous material characterized by having hydroxyl groups attached to the polymer backbone. These include glass fibers and synthetic fibers modified with hydroxyl groups. Examples of sheet products include, but are not limited to, wipers, napkins, tissues, rolls, towels or other fibrous, film, polymer, or filamentary products.

The dispenser 20 includes a front cover 22 and a back-housing 24 that are arranged to hold and dispense a product (not shown). In one embodiment, the cover 22 is coupled to the back-housing 24 by a hinge 26 and an access device 28. As will be discussed further herein, the access device 28 is an interchangeable device that allows the operator to change the security access to the internal portions of the dispenser 20. When the user activates the access device 28, the cover is allowed to rotate providing the operator with access to the internal portions of the dispenser 20. Once the operator has completed the desired tasks, such as refilling the supply of product for example, the operator rotates the cover until the access device 28 re-engages the back-housing 24.

The dispenser 20 may include further features that allow a user to interact and receive products. The dispenser 20 may have one or more handles 30 for example. When the handle 30 is pushed by the user an internal mechanism (not shown) is activated, such as a pump for example. The internal mechanism retrieves product from a supply and delivers the product to the user. Alternatively, the dispenser 20 may have a so-called "touchless" system that uses a sensor, such as an infrared sensor for example, that senses the presence of the user and provides the product in response.

In the exemplary embodiment, the cover 22 is formed from a material that is suitable for the environment in which operation is intended. The cover 22 may be formed from an injection molded plastic such as polypropylene or polyethylene for example. The cover 22 may further be made from a transparent or semi-transparent material such as poly (methyl methacrylate) (PMMA), polypropylene, polyethylene, polycarbonate or polysulphone for example. A transparent or semi-transparent cover 22 provides advantages to the operator in checking the supply of product remaining in the dispenser 20. The cover 22 includes a hole 32, shown in FIG. 2, which is sized to receive the access device 28. In the exemplary embodiment, the hole 32 is positioned in the cover 22 in an area opposite the hinge 26.

Figure 2:
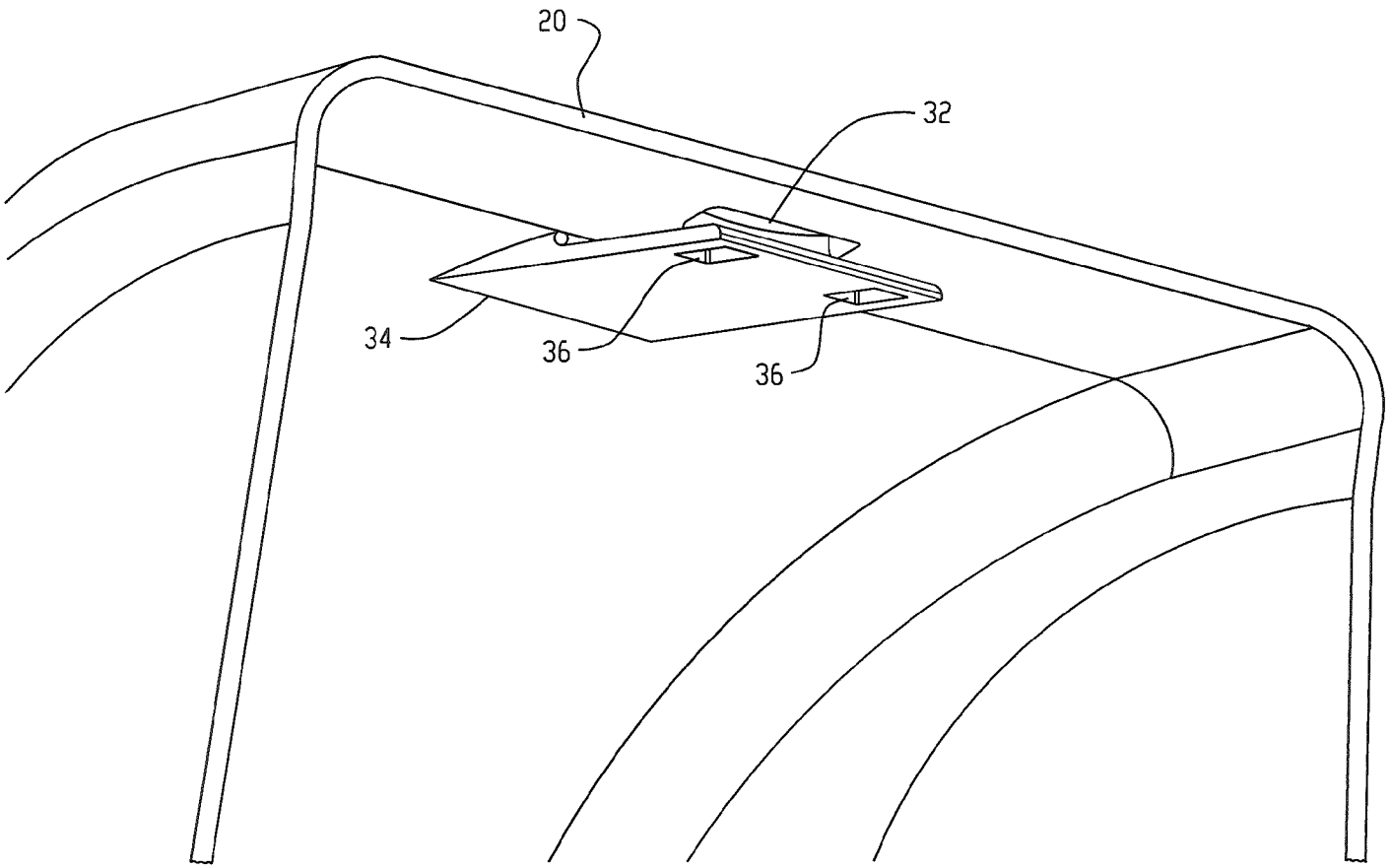
FIG. 2 is a partial perspective view illustration the dispenser cover of FIG. 1.

A latch member 34 is positioned adjacent to the hole 32. In the exemplary embodiment, the latch 34 is integrally molded with the cover 22 as illustrated in FIG. 2. However, the latch 34 may also be formed separately from the cover 22 and attached via fasteners for example. For reasons that will be made clearer herein, the latch member 34 is sized to be sufficiently elastic to allow repeated deflection under pressure from the access device 28 for the life of the dispenser 20. The latch member 34 also includes one or more holes 36. As will be discussed in more detail below, the holes 36 engage projections in the back-housing 24 to secure the top of the dispenser against the back-housing 24 when the cover 22 is in the closed position. It should be appreciated that while discussions herein refer to the latch member 34 being coupled to the cover 22 and a catch as part of the back-housing 24, these parts may be reversed without deviating from the intended scope of claimed invention.

Figure 3:
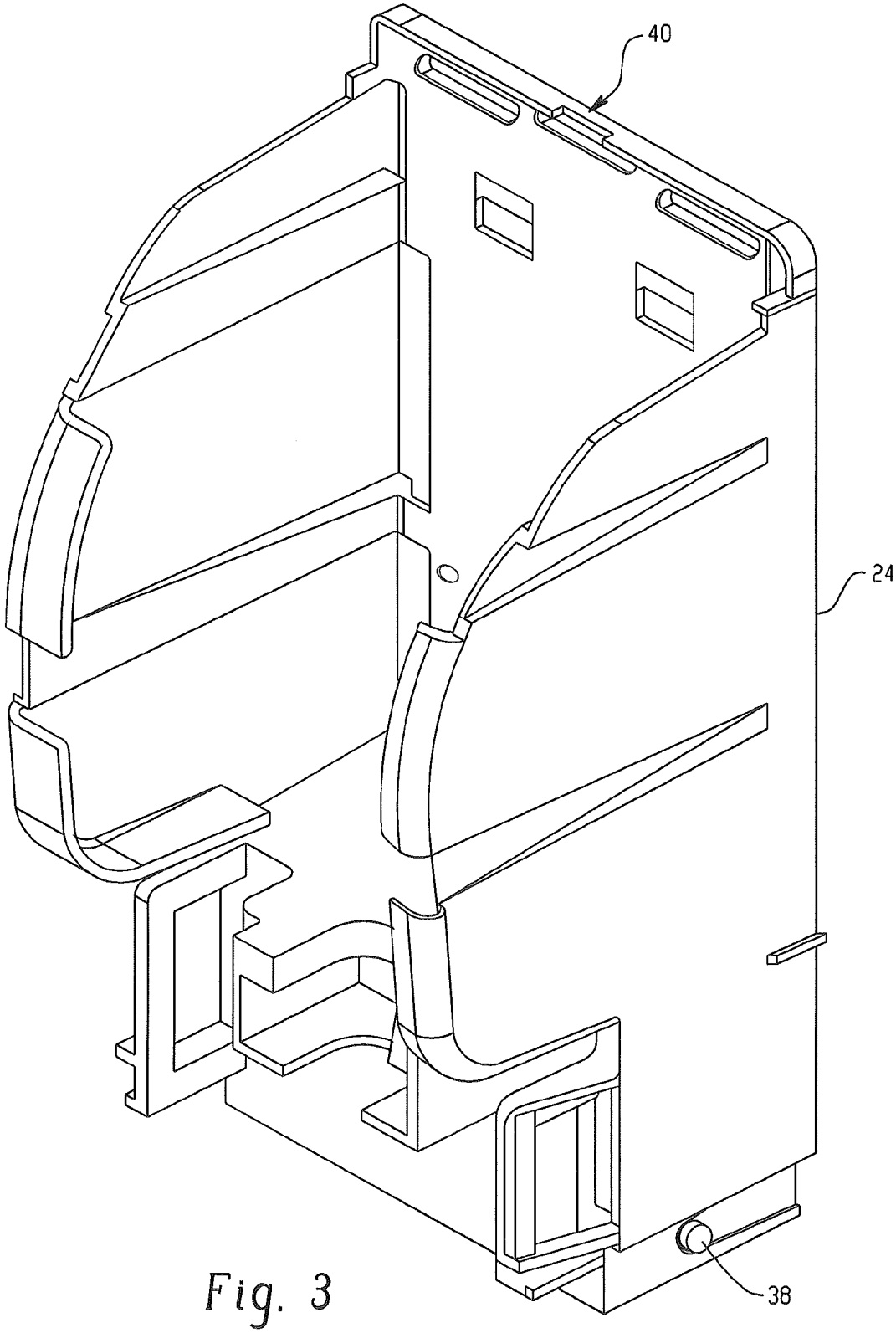
FIG. 3 is a perspective view illustration of the dispenser back-housing of FIG. 1.

The back-housing 24 includes features to support subassemblies (not shown) used in the storage and dispensing of product the user. The back-housing 24 may also incorporate features that allow the dispenser 20 to be mounted, such as to a wall, a pole or a sink for example. An exemplary embodiment back-housing 24 is illustrated in FIG. 3. As discussed above, the dispenser 20 includes a hinge 26 that allows the cover 22 to rotate relative to the back-housing 24. A portion of the hinge 26 may be incorporated into the back-housing 24, such as with a projection 38. On an end opposite the hinge projection 38, a catch 40 is integrated into the back-housing 24.

Figure 4:
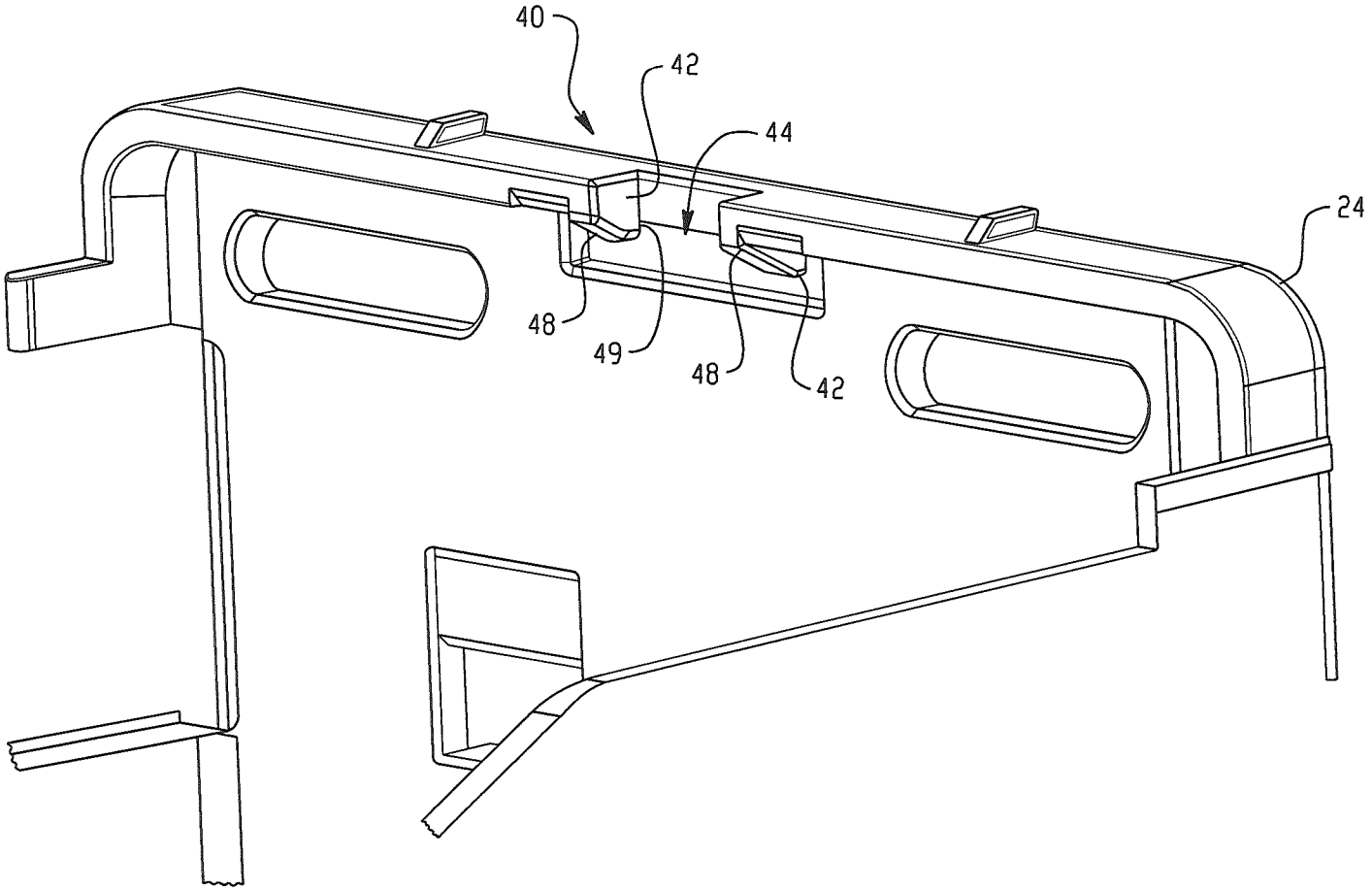
FIG. 4 is a partial perspective view illustration of the catch portion of the back-housing of FIG. 3.
Figure 6:
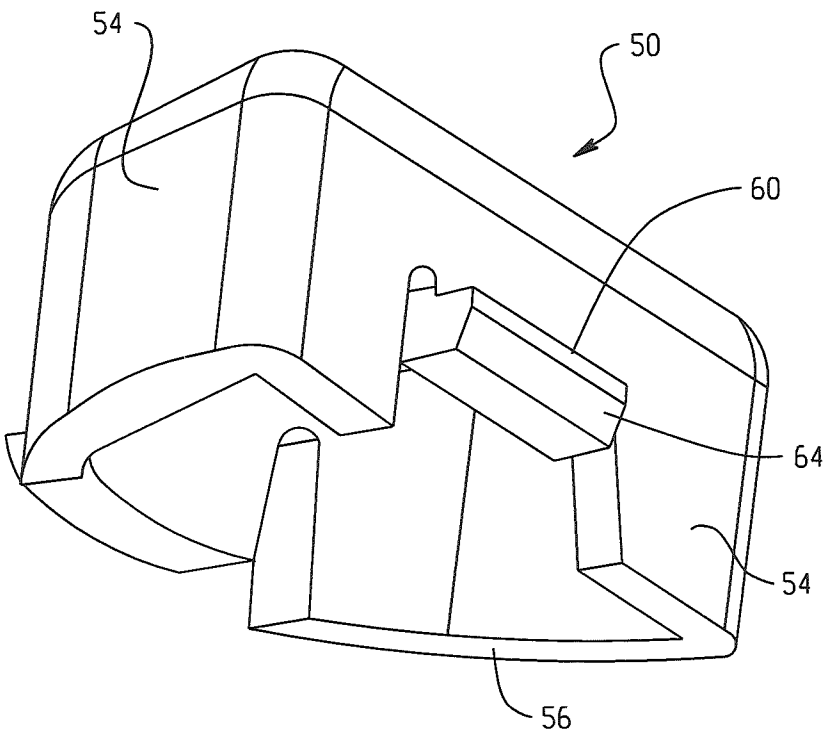
FIG. 6 is a reverse perspective view illustration of the push-button device of FIG. 5.
Figure 5:
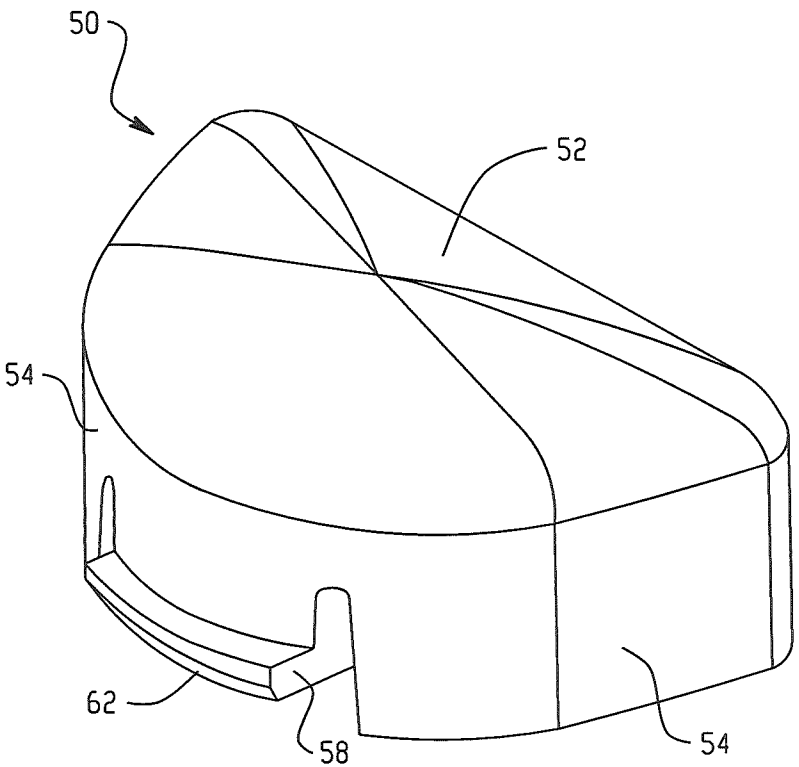
FIG. 5 is a perspective view illustration of a push-button device in accordance with an embodiment of the invention.

In the exemplary embodiment shown in FIG. 4, the catch 40 includes a pair of tabs 42 that are sized and spaced to align with the holes 36 in latch member 34. The tabs 42 include an angled surface 48 and a planar surface 49. The angled surface 48 facilitates the deflection of the latch member 34 when the cover 22 is moved towards the closed position. At a certain point during the closing of the cover 22, the leading edge of holes 32 will extend past the planar surface 49 allowing the latch member 34 to return to its original position as the tabs 42 enter into the holes 36. To facilitate the engagement of the tabs 42 into the holes 36, the back-housing 24 further includes a slot 44 adjacent to the tabs 42. The slot 44 provides clearance for the latch member 34 to extend past the surface 46 of the back-housing 24 to allow the latch member 34 to engage the tabs 42 into the holes 36. The slot 44 is further sized to allow the deflection of the latch member 34 during the engagement and disengagement of the latch member 34 from the catch 40.

The disengagement of the latch member 34 from the catch 40 is accomplished by the activation of the access device 28 that is positioned adjacent to the latch member 34 in the cover 22. The access device 28 may be any device that may be interchangeably installed in the hole 32 in cover 22. It should be appreciated that the interchangeable access device 28 provides advantages in reducing the inventory of the installer and manufacturer. The interchangeability of the access device 28 allows the manufacture and stocking of a single dispenser 20 that may be used in different applications that have different security requirements.

Exemplary interchangeable access devices 28 are illustrated in FIGS. 5-10. The first exemplary access device is a push-button device 50 illustrated in FIG. 5 and FIG. 6. The push-button device 50 includes a top surface 52 that provides an activation surface for the user to interact with the latch member 34. A plurality of walls 54 extends generally perpendicular to the surface 52 and end in a bottom surface 56. Push-button device 50 further includes a first tab 58 and a second tab 60 arranged on either side of the push-button device 50. To install the push-button device 50, the installer positions the push-button device 50 over the hole 32. The angled surfaces 62, 64 on the tabs 58, 60 contact the edge of the hole 32 causing the tabs 58, 60 to deflect inward as the installer pushed on the push-button device 50. The tabs 58, 60 provide a snap-fit into the hole 32 and retain the push-button device 50 in the cover 22. During operation, the surface 56 contacts the surface of latch member 34 in response to the operator applying a force to the surface 52 such as with one of their fingers. To replace the push-button device 50, the operator opens the cover 22 and deflects the tabs 58, 60 and pushes the push-button device 50 away from the latch member 34.

Figure 10:
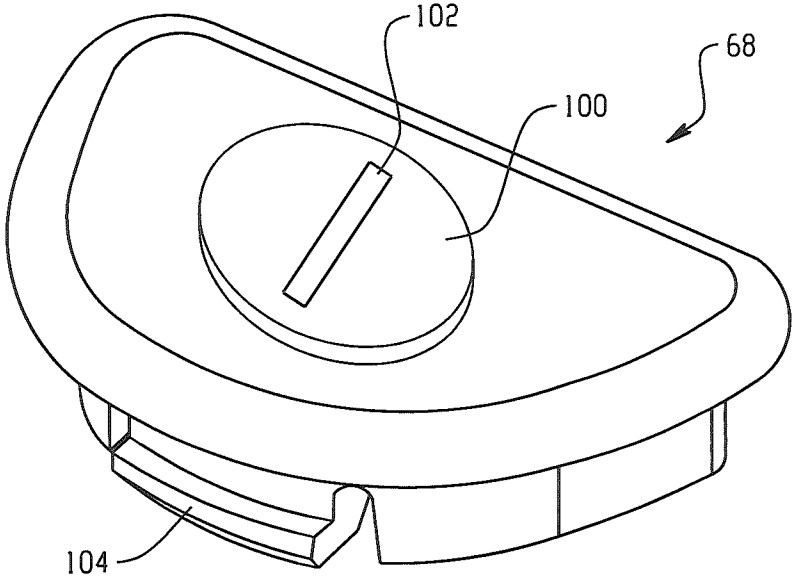
FIG. 10 is a perspective view illustration of a keyed-button device having a cylinder tumbler lock.

It should be appreciated that the push-button device 50 provides little security for the product contained in the dispenser 20. In applications where vandalism or theft is of concern to the operator, the installer may use an access device that requires a key or a tool to cause the deflection of latch member 34, such as the keyed-device 66 (FIGS. 7-9) or rotary-tumbler device 68 (FIG. 10). In these embodiments, the operator uses a key or tool to cause the latch member 34 to disengage from the catch 40. This provides a higher level of security that prevents or inhibits unauthorized access to the interior of the dispenser 20.

Figure 8:
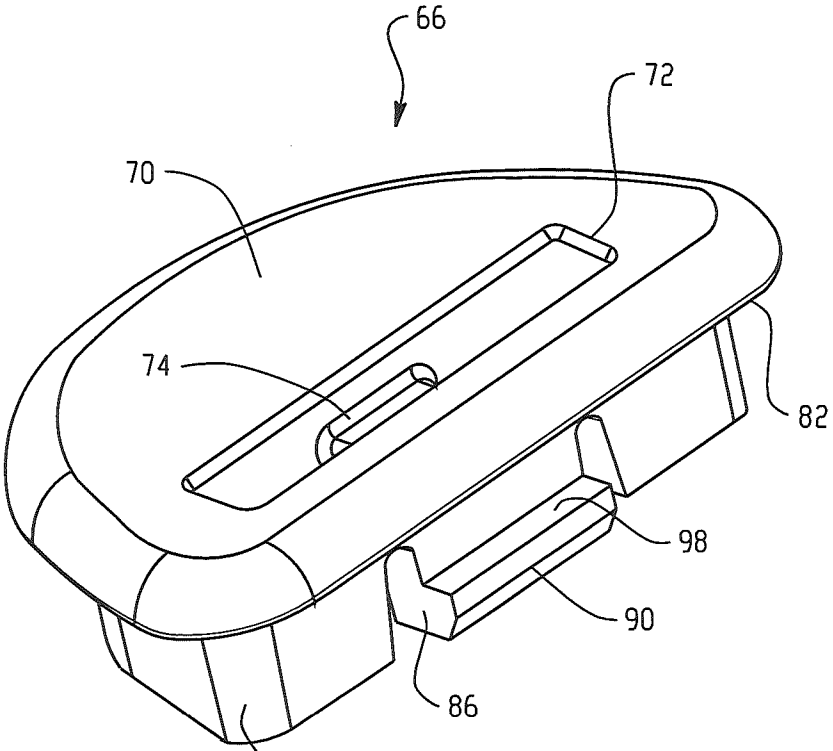
FIG. 8 is a reverse perspective view illustration of the keyed-button device of FIG. 7.
Figure 7:
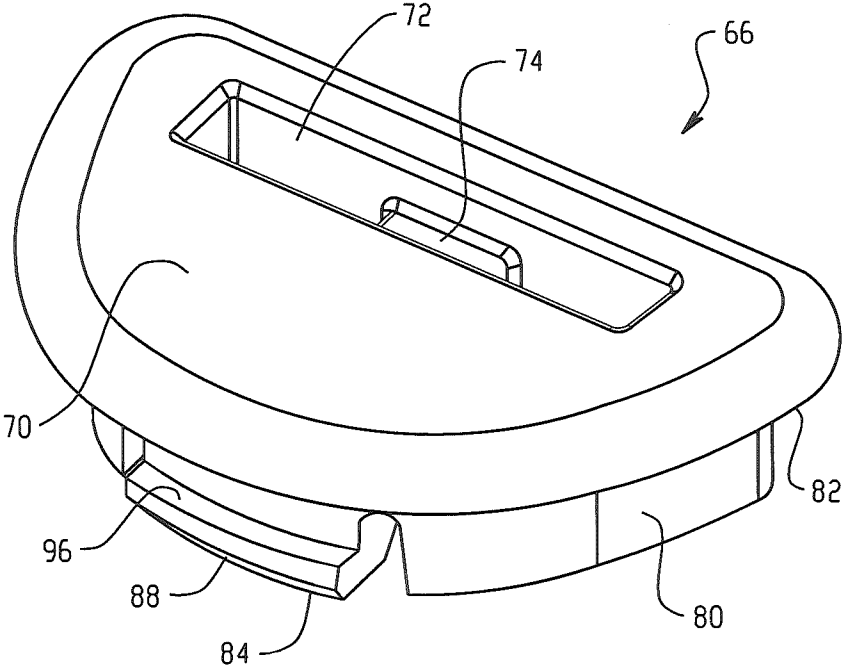
FIG. 7 is a perspective view illustration of a keyed-button device in accordance with an embodiment of the invention.
Figure 9:
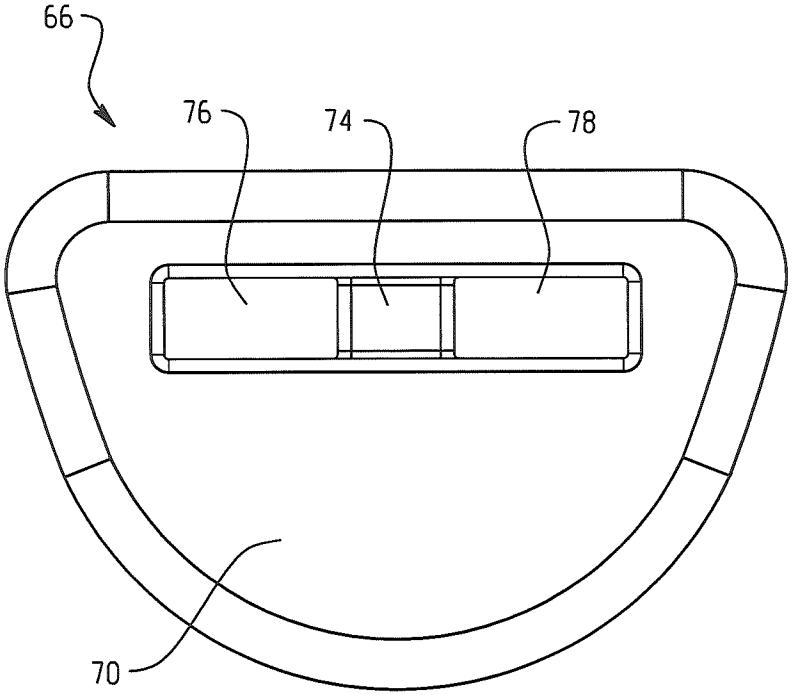
FIG. 9 is a plan view illustration of the keyed-button device of FIG. 7.

The keyed-device 66 includes a top surface 70 having an opening 72 that extends through the keyed-device 66 as shown in FIGS. 7-9. A post 74 extends across the opening 72 bifurcating the opening into two slots 76, 78. Similar to the push-button device 50, the keyed-device 66 has walls 80 that extend away from the surface 70. However, the walls 80 are offset from the edge of the surface 70 forming a lip 82. A first tab 84 and second tab 86 are formed in the walls 80. The tabs 84, 86 each include an angled surface 88, 90 to facilitate the installation of keyed-device 66 into the hole 32. The tabs 84, 86 are sized to provide a snap-fit that secures the keyed-device 66 to the cover 22. The keyed-device 66 operates with a key 92 (FIG. 13) that includes a pair of arms 94 that are sized to fit within the slots 76, 78.

As with the push-button device 50, the keyed-device 66 may be installed or removed at the point of installation of the dispenser 20. Due to the snap-fit created by the tabs 84, 86, the keyed-device 66 is installed by aligning the keyed-device 66 to the hole 32 and pushing the keyed-device into the hole. This causes the tabs 84, 86 to deflect until the keyed-device 66 is fully inserted whereupon the tabs 84, 86 will revert to their original position. The surfaces 96, 98 on tabs 84, 86 engage the underside of the cover 22 retaining the keyed-device 66 in the cover 22. To remove the keyed-device 66, the operator opens the cover, deflects the tabs 84, 86 causing the snap-fit to disengage and allowing the keyed-device to be pushed out of the hole 32.

The rotary-tumbler device 68 illustrated in FIG. 10 is similar to the keyed-device 66. However instead of having a slot that extends through, the rotary-tumbler device 68 includes a rotary pin tumbler mechanism 100. The rotary pin tumbler mechanism 100 is a lock mechanism that uses pins of varying lengths to prevent the lock from opening without the correct key. The mechanism 100 has a straight-shaped keyway 102 at one end to allow the key to enter the mechanism 100. Opposite the keyway 102 is a cam or lever (not shown) that activates the latch member 34. With a key properly cut and inserted into the keyway 102, the pins (not shown) in the mechanism 100 will rise causing them to align allowing the mechanism 100 to rotate and activate the latch member 34. When the key is not in the lock, the pins in the mechanism 100 prevent the mechanism from rotating. Similar to the push-button device 50 and the keyed-device 66, the rotary-tumbler device 68 includes tabs 104 that provide a snap-fit into the cover hole 32.

Figure 11:
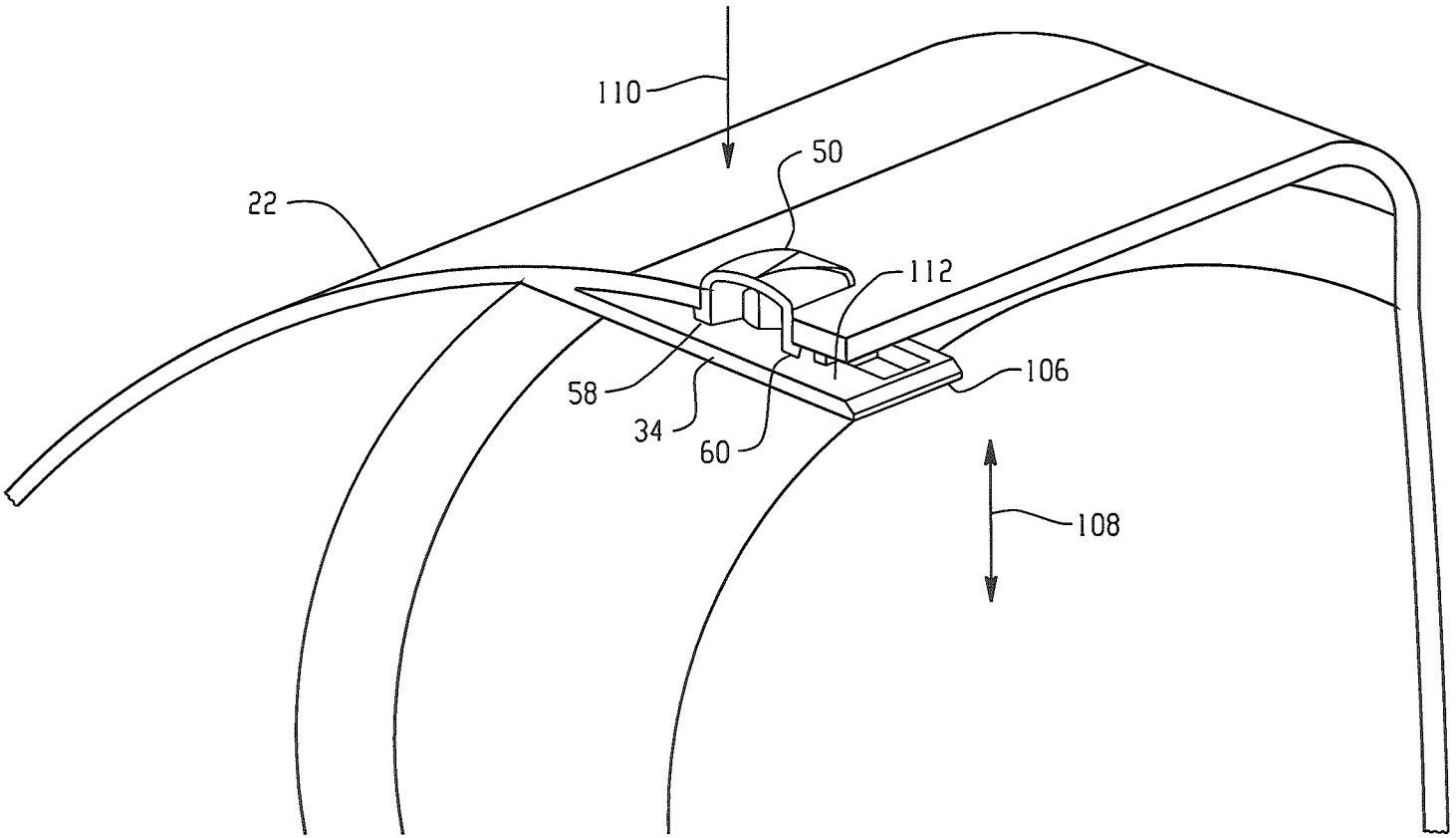
FIG. 11 is a partial sectional perspective view of the dispenser cover with the push-button device installed and the back-housing removed.
Figure 12:
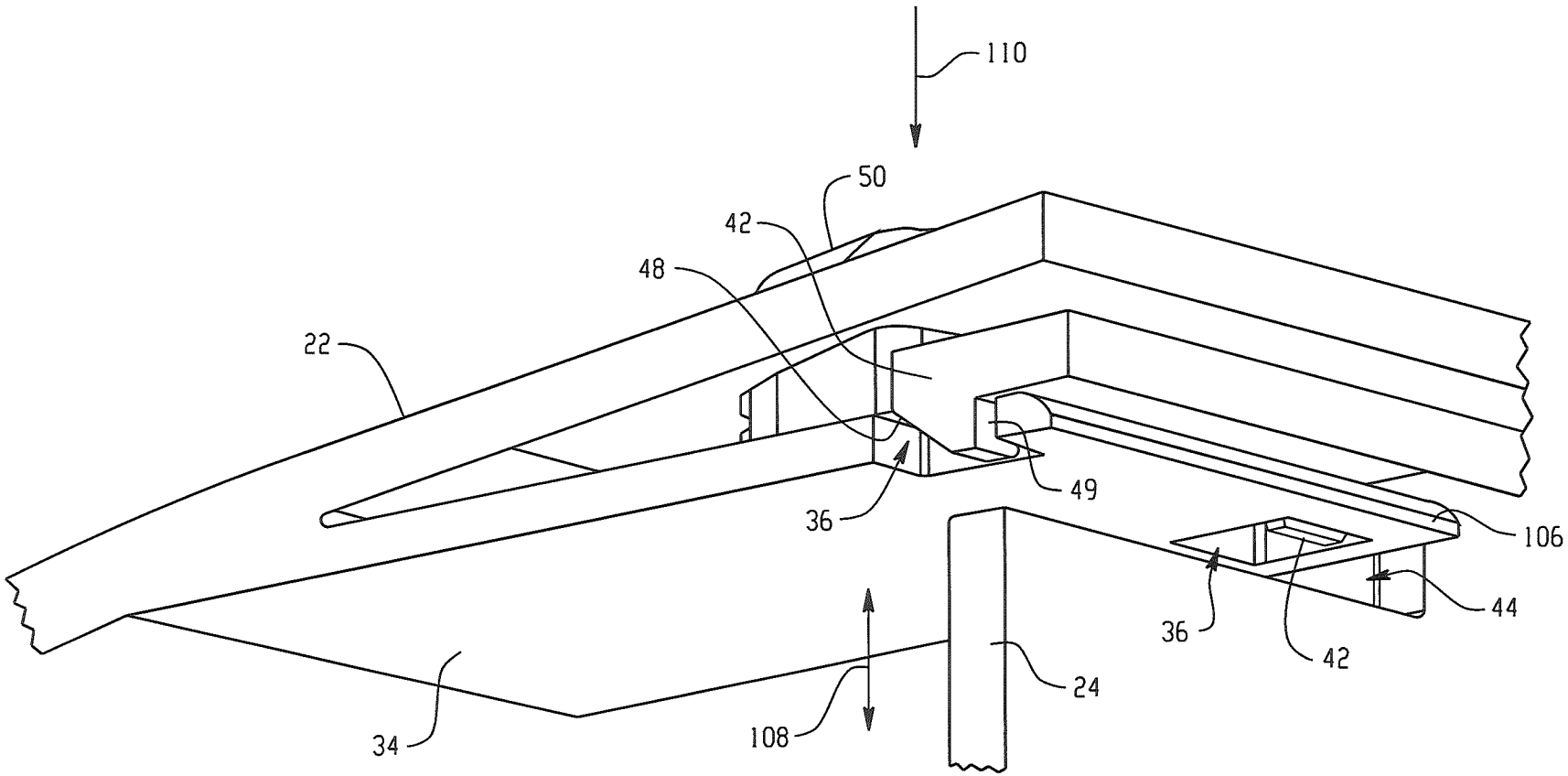
FIG. 12 is a partial sectional reverse perspective view of the dispenser cover with the push-button device installed.

During operation, the method used by the operator to access the interior portion of the dispenser 20 will depend on which access device 28 is installed in the cover 22. Referring now to FIG. 11 and FIG. 12, the operation of the push-button device 50 will be described. When the cover 22 is moved from the open to the closed position, the latch member 34 approaches the slot 44 in the back-housing 24. The leading surface 106 of the latch member 34 contacts the angled-surface 48 on the tab 42. Due to the relative stiffness of the tab 42 in comparison to the latch member 34, the latch member 34 deflects in the direction indicated by arrow 108. As the operator continues to rotate the cover 22 towards the closed position, the latch member 34 remains in a deflected position until the holes 36 align with the tabs 42. Once the edges of the holes 36 move past the surfaces 49 of the tabs 42, the elasticity of the latch member 34 causes the latch member 34 to return to its original position. At this point, if there is an attempt to open the cover 22, the surfaces 49 of the tabs 42 will contact the sides of the holes 36 and prevent further movement. Thus, the cover is in a latched closed position and cannot be opened without taking additional action.

To open the cover 22, the operator exerts a force, such as with their hand for example, in the direction indicated by arrow 110. This causes the surface 56 on the push-button device 50 to contact the top surface 112 of the latch member 34. If the force in the direction 110 is sufficient, the latch member 34 will deflect in the direction of arrow 108 and the holes 36 will offset from the tabs 42. Once the holes 36 are clear of the tabs 42, the cover 22 may freely rotate to the open position and restocking of the product supply or maintenance tasks may be performed.

Figure 13:
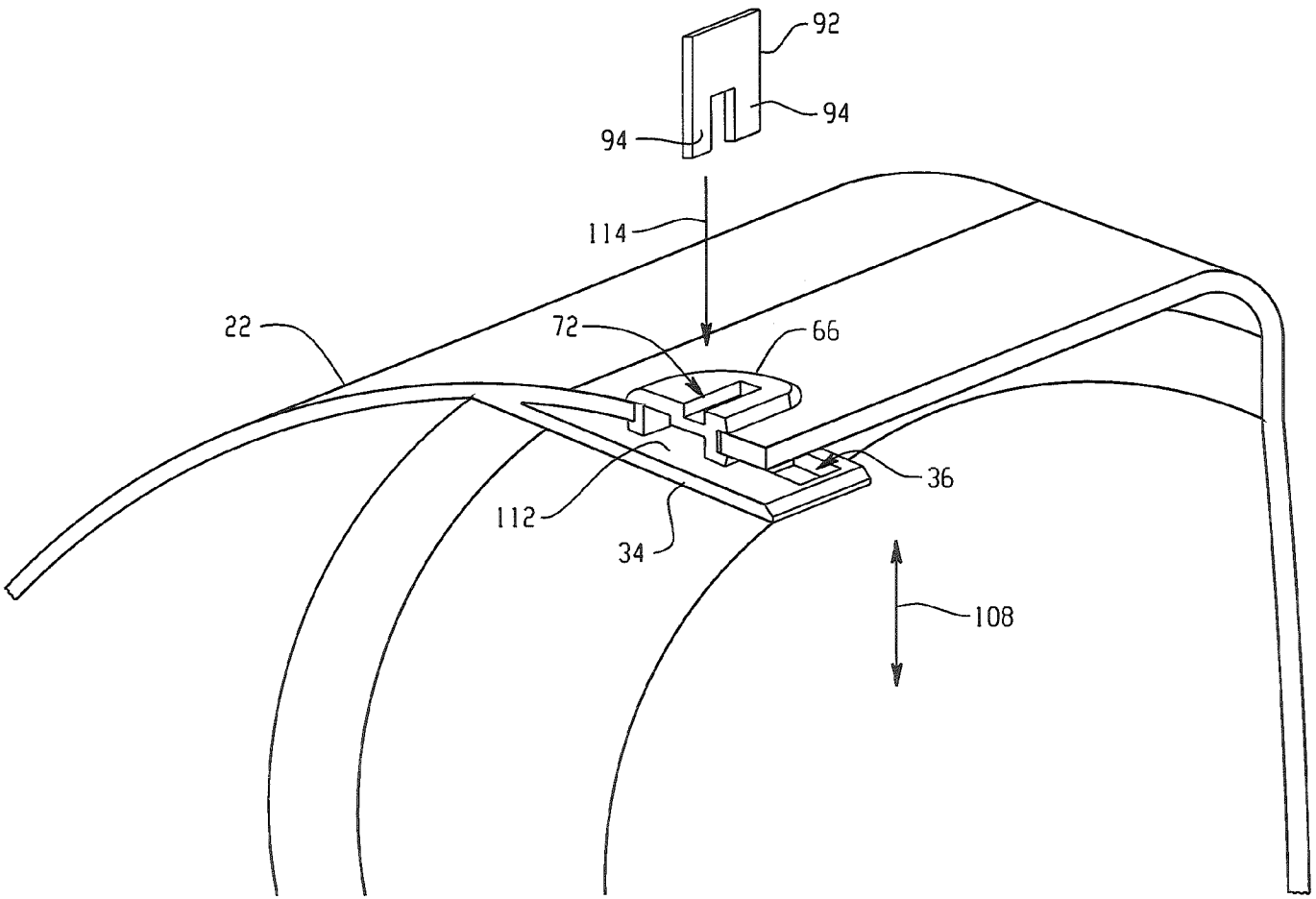
FIG. 13 is a partial sectional perspective view of the dispenser with the keyed-button device installed.

The operation of the keyed-device 66 is illustrated in FIG. 13. In this embodiment, the keyed-device 66 does not contact the latch member 34 since the lip 82 and the tabs 84, 86 prevent movement relative movement between the cover 22 and the keyed-device 66. To open the cover 22, the operator needs the key 92. The key 92 has a pair of arms 94 that straddles either side of the post 74 when the key 92 is inserted into the opening 72 in the direction indicated by arrow 114. Once inserted in the opening 72, the key 92 contacts the surface 112 of the latch member 34. If sufficient force is applied by the operator, the key 92 will cause the latch member 34 to deflect in the direction indicated by arrow 108. As described above with the push-button device 50, the deflection of the latch member 34 allows the holes 36 to clear the tabs 42 and the cover 22 may be rotated to the open position. It should be appreciated that the operation of the latch member 34 and the tabs 42 during the process of closing the cover 22 remains the same as that described above with respect to the push-button device 50.

As discussed above, it should be appreciated that while embodiments have been discussed herein referring to a (flexible) latch member 34 being coupled to the cover 22, and a (rigid) catch member 40 being part of the back-housing 24, these parts may be reversed without deviating from the intended scope of the claimed invention. That is, the flexible latch member may be coupled to the back-housing 24, and herebelow referred to as latch 34', and the rigid catch member may be coupled to the cover 22, and herebelow referred to as catch 40'. Also as discussed above, the access device 28 may be any device that may be interchangeably installed in a suitably shaped hole 32 in the cover 22. Yet further as discussed above, the dispenser 20 may be any type of dispenser, such as a soap dispenser, a liquid soap dispenser, a foam dispenser or a sheet product dispenser. Accordingly, and where FIGS. 5-13 discussed example interchangeable access devices 28 for a soap dispenser 20 in the form of a push-button device 50, a keyed-device 66 utilizing a key 92, and a rotary-tumbler device 68, FIGS. 14-20 (where reference to FIG. 17 means reference to FIGS. 17A-17E, reference to FIG. 18 means reference to FIGS. 18A-18E, reference to FIG. 20 means reference to FIGS. 20A-20E, and reference to FIG. 21 means reference to FIGS. 21A-21E) will now be discussed in connection with other alternative access devices 28 for a sheet product dispenser 20'. However, it will be appreciated that any and all such access devices may be employed in any type of dispenser.

Referring to FIGS. 14-18, an example sheet product dispenser 20' includes a front cover 22' and a back-housing 24', where the cover 22' is coupled to the back-housing 24' by an access device 28 in the form of a push button insert 300 disposed in a key insert 200, which is coupled to the cover 22' via an opening 32'. As used herein, reference numerals identical to those discussed above in connection with FIG. 1-13, but with the addition of a prime symbol ('), are intended to refer to similar structure as that discussed above in connection with FIGS. 1-13, but for use with the alternative access device 28 described herebelow.

In an embodiment, the key insert 200 is disposed to be removably coupled to an opening 32' of the cover 22', a push button insert 300 is disposed to be removably coupled to the key insert 200, and a key device 92 (see FIG. 13) is disposed to be removably coupled to the key insert 200, via an opening 204 (see FIGS. 17A and 17D) sized to receive the key device 92, which is configured to cooperate with a flexible latch 34' formed on the back-housing 24' to disengage the latch 34' from a rigid catch 40' formed on the cover 22' when the key device 92 is inserted in the opening 204 of the key insert 200. The push button insert 300 and the key device 92 are mutually interchangeable with each other for being removably coupled to the key insert 200 by a user.

Figure 14:
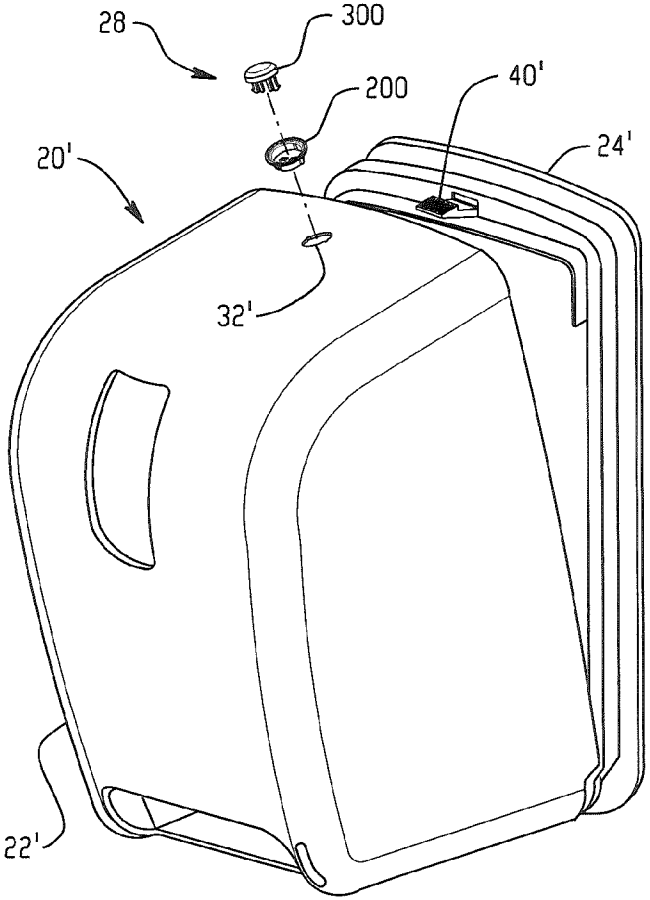
FIG. 14 is a perspective exploded assembly view illustration of an alternative dispenser to that of FIG. 1 in accordance with an embodiment of the invention.

With reference briefly to FIGS. 2 and 14, it can be seen that opening 32 has a non-circular shape, while opening 32' has a circular shape. As such, it will be appreciated that the shape of the opening 32, 32' is selected to appropriately match the type of access device 28 to be employed, and in no way is intended to limit the scope of the invention disclosed herein.

Figure 15:
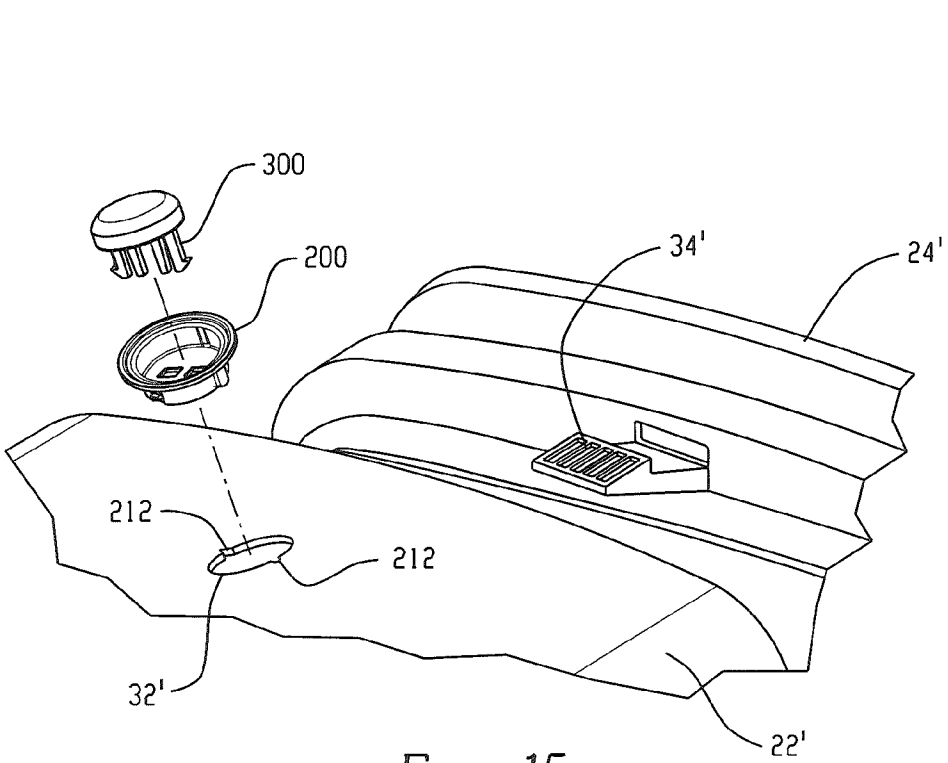
FIG. 15 is a partial perspective exploded assembly view illustration of the cover, back-housing, and push button access device of the dispenser of FIG. 14.
Figure 16:
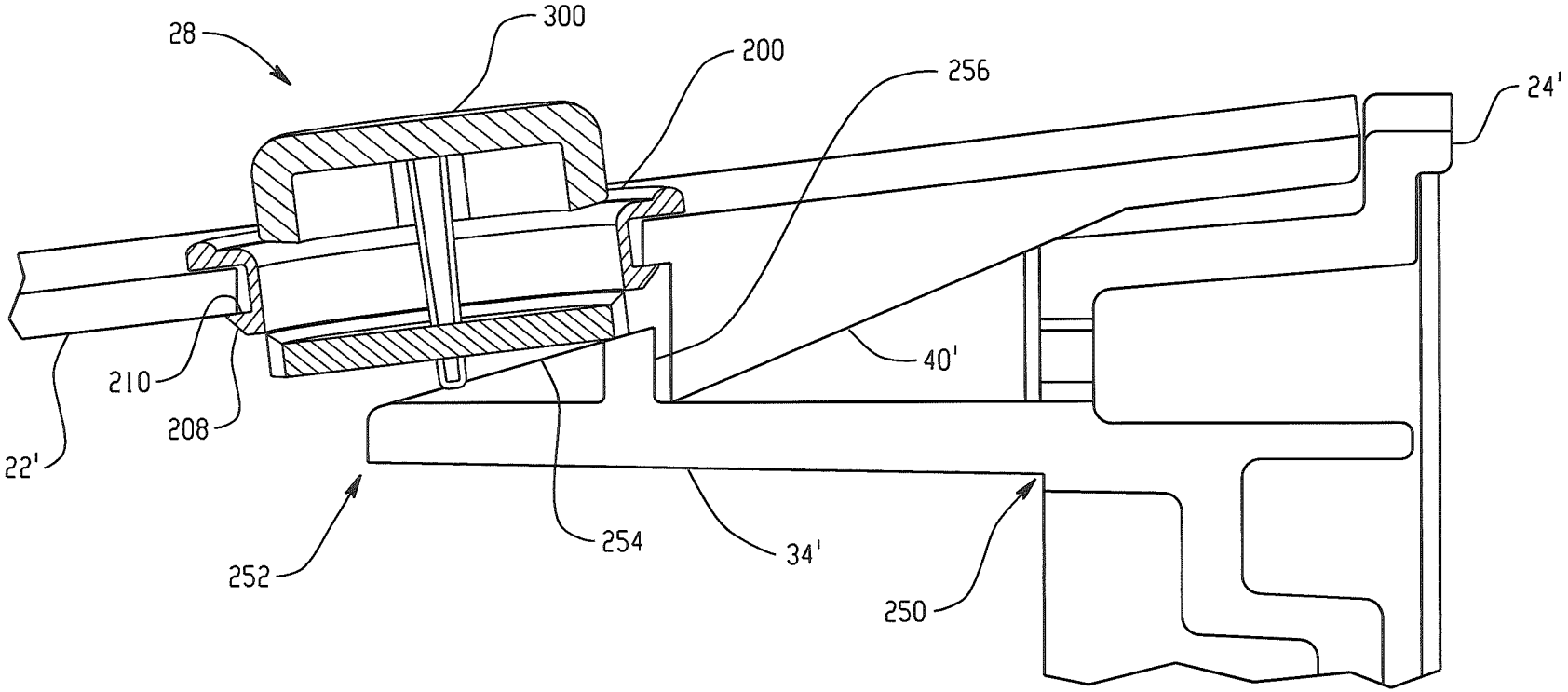
FIG. 16 is a partial cutaway side view illustration of the cover, back-housing, and access device of the dispenser of FIG. 14.
Figure 17D:
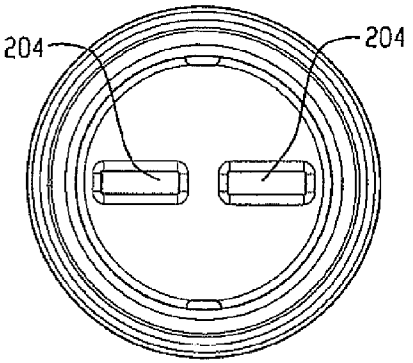
FIG. 17D is a top orthogonal view illustration of the key insert of FIG. 17A.
Figure 17E:
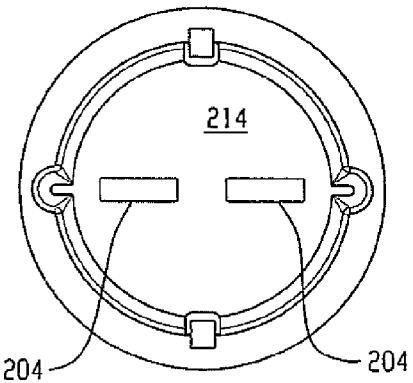
FIG. 17E is a bottom orthogonal view illustration of the key insert of FIG. 17A.
Figure 17A:
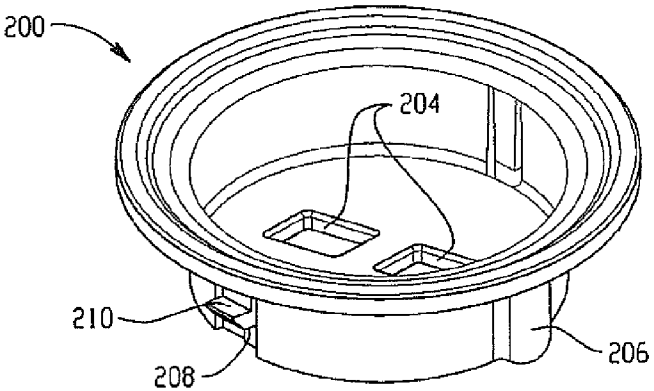
FIG. 17A is a perspective view illustration of a key insert usable in the dispenser of FIG. 14 in accordance with an embodiment of the invention.
Figure 17B:
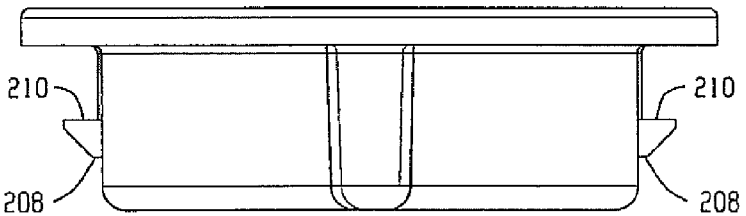
FIG. 17B is a first orthogonal side view illustration of the key insert of FIG. 17A.
Figure 17C:
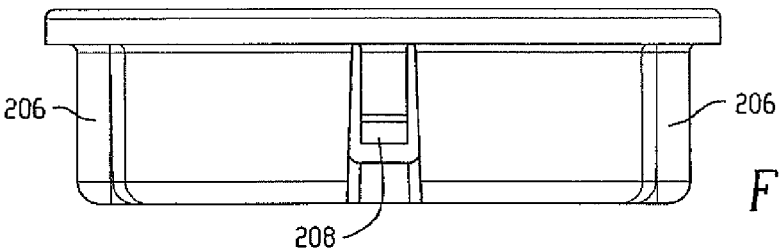
FIG. 17C is a second orthogonal side view illustration of the key insert of FIG. 17A.
Figure 18A:
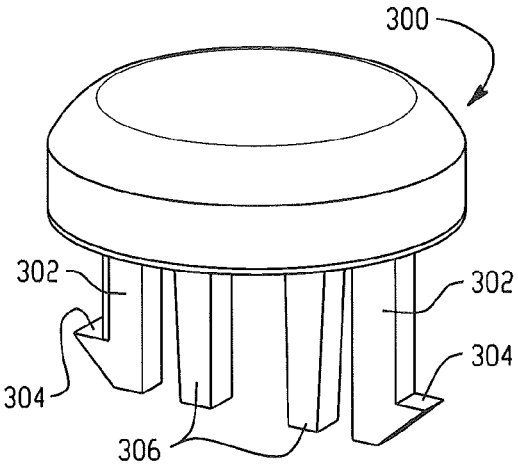
FIG. 18A is a perspective view illustration of a push button insert usable in the key insert of FIG. 17A in accordance with an embodiment of the invention.
Figure 18D:
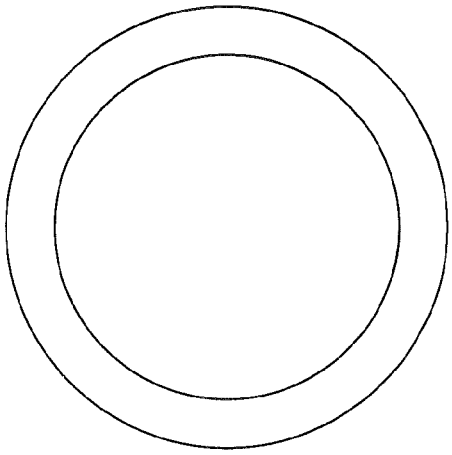
FIG. 18D is a top orthogonal view illustration of the push button insert of FIG. 18A.
Figure 18B:
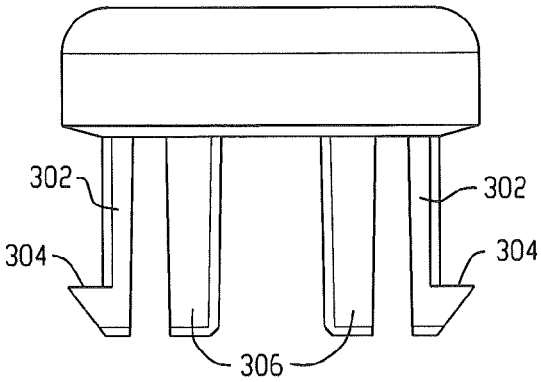
FIG. 18B is a first orthogonal side view illustration of the push button insert of FIG. 18A.
Figure 18E:
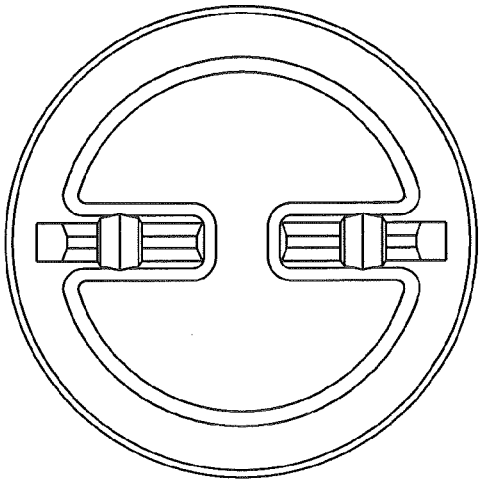
FIG. 18E is a bottom orthogonal view illustration of the push button insert of FIG. 18A.
Figure 18C:
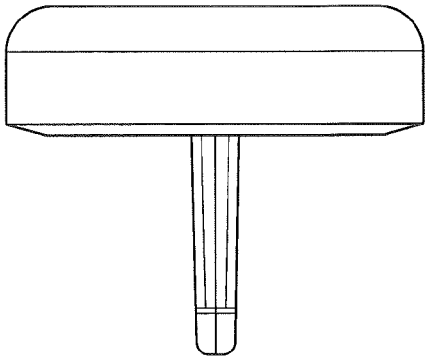
FIG. 18C is a second orthogonal side view illustration of the push button insert of FIG. 18A.

As depicted in FIGS. 15 and 16, the latch 34' is a flexible cantilevered member having a fixed end 250 formed on the back-housing 24' and an opposing flexible end 252 disposed a distance away from the fixed end 250, such that the flexible end 252 is capable of deflecting downward when a downward force (as viewed from the perspective of FIG. 16) is exerted at the flexible end 252. As illustrated in FIG. 16, the latch 34' has a ramp portion 254 that forms a latching surface 256 that engages with a mating surface on the catch 40'. Sufficient downward deflection of the latch 34' permits the latching surface 256 to clear the catch 40' to allow the cover 22' to be opened relative to the back-housing 24'.

The key insert 200 (best seen by referring to FIGS. 17A-17E) includes a pair of diametrically opposed ribs 206, and a pair of diametrically opposed flexible tabs 208 with each tab 208 having a snap-fit edge 210 that snap-fit engages with an underside surface of the cover 22'. The ribs 206 are disposed to align and mate with a pair of slots 212 in the cover 22' when the key insert 200 is positioned in the opening 32' of the cover 22' to prevent undesired rotation of the key insert 200 once installed in the cover 22'. The snap-fit edges 210 removably secure the key insert 200 to the cover 32'.

While an embodiment of the invention in disclosed herein having slots 212 in the cover 22', and ribs 206 as part of the key insert 200, it will be appreciated that the scope of the invention is not so limited to only slots and ribs used for the purpose of aligning one member with another, but also encompasses any other type of alignment feature for the purpose disclosed herein. As such, the term "slots" as used herein is intended to mean a "first alignment feature", and the term "ribs" as used herein is intended to mean a "second alignment feature".

The push button insert 300 (best seen by referring to FIGS. 18A-18E) includes a pair of diametrically opposed flexible tabs 302 with each tab 302 having a snap-fit edge 304 that passes through respective openings 204 of the key insert 200 and snap-fit engages with an underside surface 214 of the key insert 200. The push button insert 300 also includes a pair of actuation legs 306 that also pass through the respective openings 204. The push button insert 300 is in a first detent position when the push button insert 300 is first inserted into the key insert 200 and the snap-fit edges 304 are in close proximity to the underside surface 214 of the key insert 200. When disposed in the key insert 200, the actuation legs 306 of the push button insert 300 cooperate with the flexible end 252 of the latch 34' to disengage the latch 34' from the catch 40' when the push button insert 300 is moved downward (as viewed from the perspective of FIG. 16) from its first detent position to a second depressed position. The flexible action of the latch 34' biases the push button insert 300 toward the first detent position.

Figure 19:
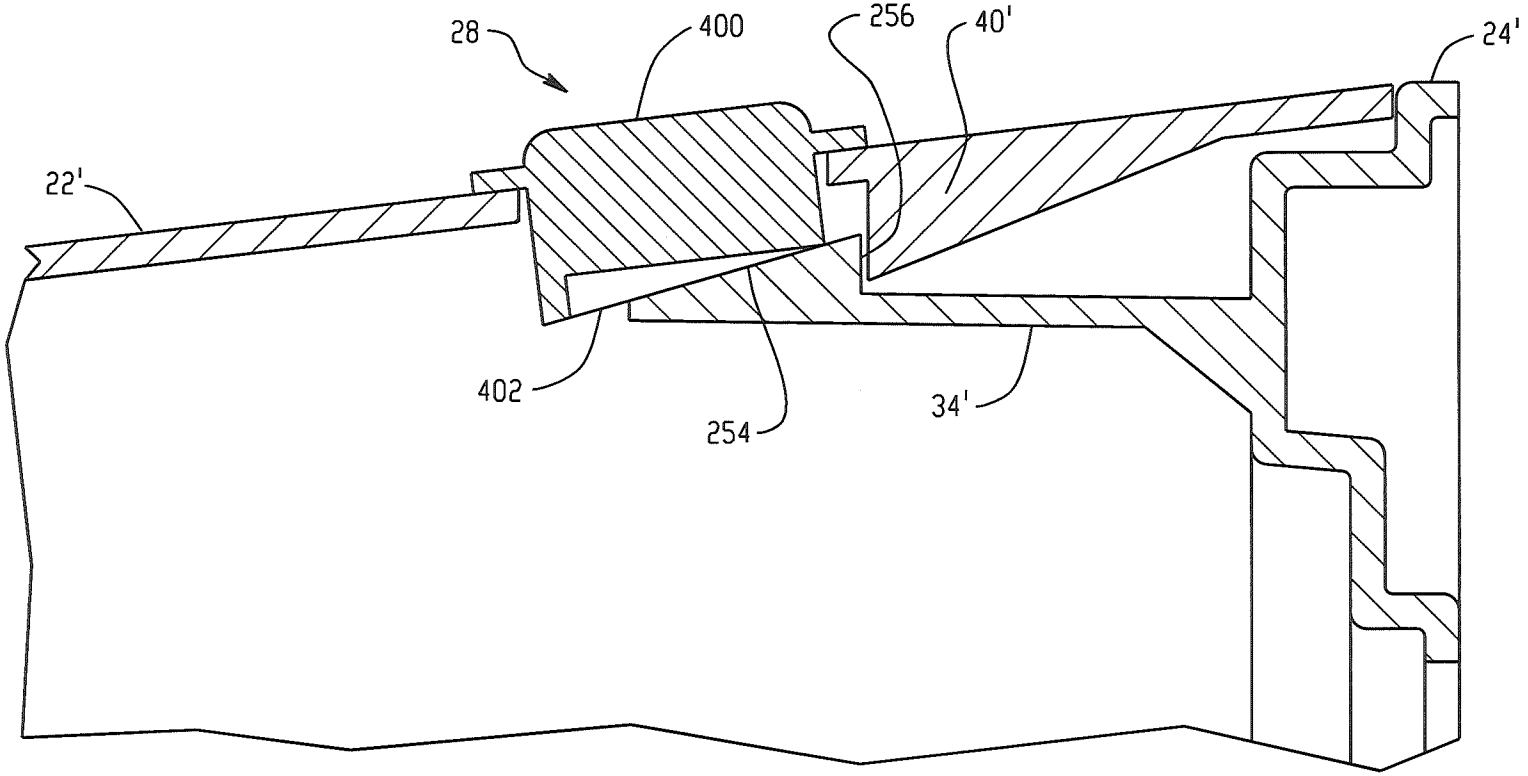
FIG. 19 is a partial cutaway side view illustration of the cover and the back-housing of FIG. 14, and of an alternative access device for use in the dispenser of FIG. 14.
Figure 20A:
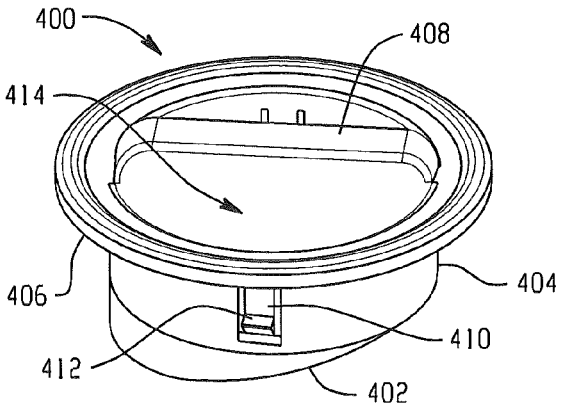
FIG. 20A is a perspective view illustration of a twist insert access device usable in place of the key insert and push button insert access device of FIGS. 14-16 in accordance with an embodiment of the invention.
Figure 20D:
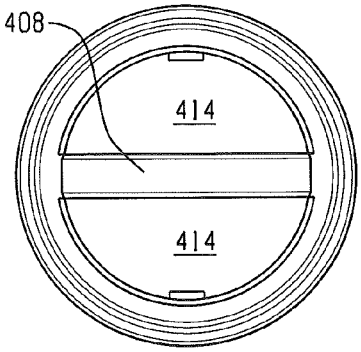
FIG. 20D is a top orthogonal view illustration of the twist insert of FIG. 20A.
Figure 20B:
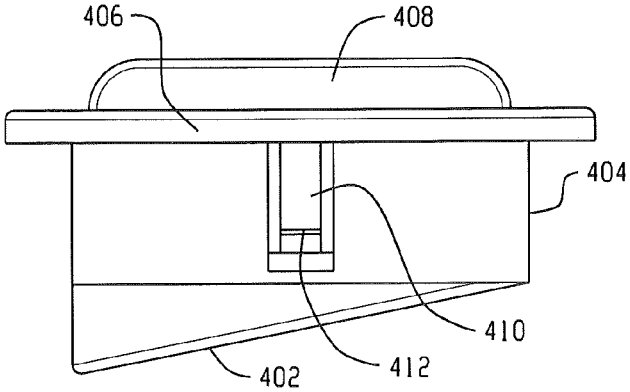
FIG. 20B is a first orthogonal side view illustration of the twist insert of FIG. 20A.
Figure 20E:
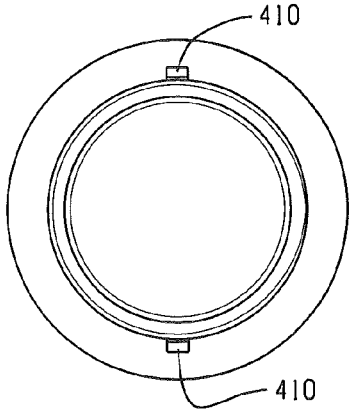
FIG. 20E is a bottom orthogonal view illustration of the twist insert of FIG. 20A.
Figure 20C:
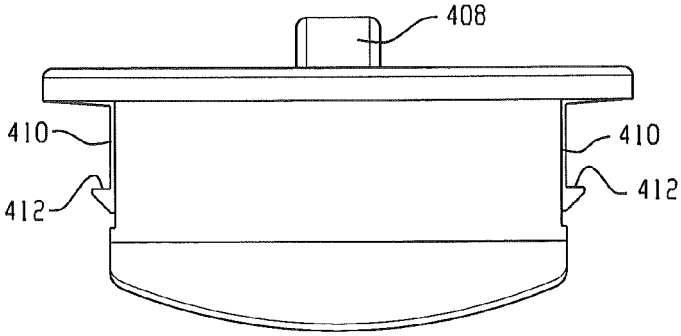
FIG. 20C is a second orthogonal side view illustration of the twist insert of FIG. 20A.
Figure 21A:
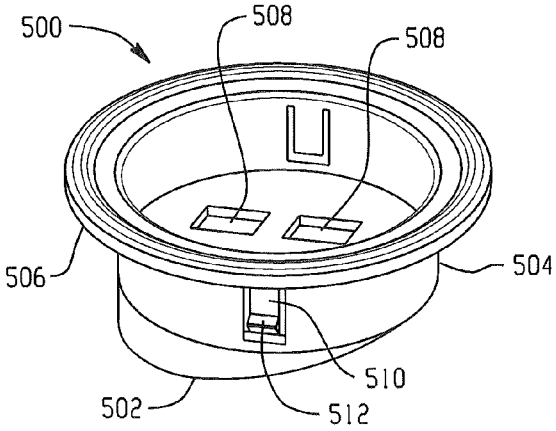
FIG. 21A is a perspective view illustration of a keyed twist insert access device usable in place of the key insert and push button insert access device of FIGS. 14-16, and usable in place of the twist insert access device of FIGS. 20A-20E, in accordance with an embodiment of the invention.
Figure 21D:
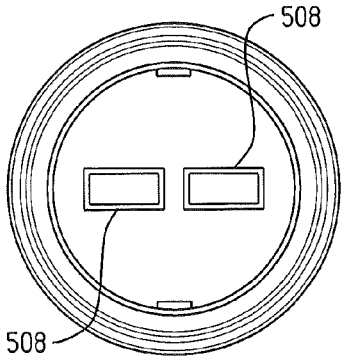
FIG. 21D is a top orthogonal view illustration of the keyed twist insert of FIG. 21A.
Figure 21B:
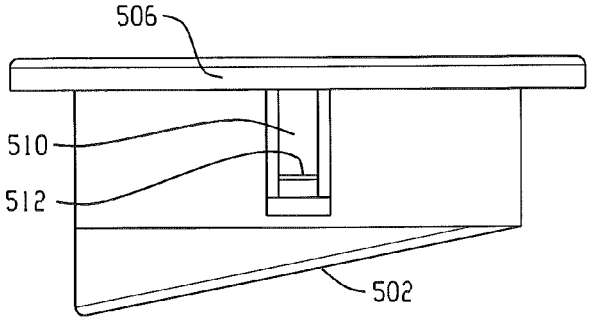
FIG. 21B is a first orthogonal side view illustration of the keyed twist insert of FIG. 21A.
Figure 21E:
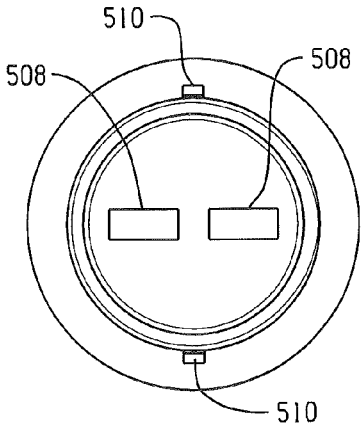
FIG. 21E is a bottom orthogonal view illustration of the keyed twist insert of FIG. 21A.
Figure 21C:
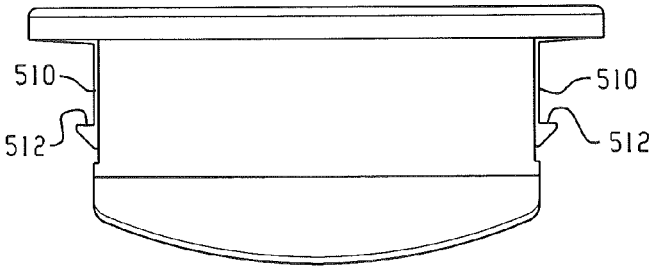
FIG. 21C is a second orthogonal side view illustration of the keyed twist insert of FIG. 21A.

Referring now to FIG. 19, an alternative assembly to that depicted in FIG. 16 includes an access device 28 formed by a twist insert 400 that is rotatably engaged with the cover 22' via opening 32'. As best seen by now referring to FIGS. 20A-20E, the twist insert 400 includes a ramp portion 402 that engages with the flexible end 252 of the latch 34', which itself has a ramp portion 254 that forms a latching surface 256 that engages with the catch 40' (as clearly depicted in FIGS. 16 and 19). In a first detent position, the ramp portion 402 of the twist insert 400 does not engage the ramp portion 254 of the latch 34' (as depicted in FIG. 19), but when twisted up to 180-degrees to a second position, the ramp portion 402 engages the ramp portion 254 with a cam action to cause deflection of the latch 34' sufficient to disengage the latch 34' from the catch 40' so that the cover 22' can be opened relative to the back-housing 24'.

As depicted by FIGS. 20A-20E, an embodiment of the twist insert 400 includes a cylindrical body portion 404 configured to removably fit in the opening 32' of the cover 22', a flange portion 406 that engages with an outer surface of the cover 22' when the twist insert 400 is disposed in the opening 32' of the cover 22' and an engagement portion 408 disposed to be accessible to a user when the twist insert 400 is disposed in the opening 32' of the cover 22'. Flexible tabs 410, each having a snap-fit edge 412, snap-fit engages with an underside surface of the cover 22' when the twist insert 400 is fit into the opening 32' of the cover 22'.

In an embodiment, the engagement portion 408 forms a projection or rib (also referred to by reference to numeral 408) that extends across the twist insert 400, the projection being configured to be accessible by a user's fingers for twisting the twist insert 400 from the first position to the second position. In an embodiment, the twist insert 400 includes pockets 414 on each side of the projection/rib 408 for allowing a user's fingers to sufficiently engage with the engagement portion 408.

Referring now to FIGS. 21A-21E, an alternative access device 28 to that depicted in FIGS. 20A-20E is illustrated as being a keyed twist insert 500 that is rotatably engaged with the cover 22' via opening 32'. As with the twist insert 400, the keyed twist insert 500 also includes a ramp portion 502 that engages with the flexible end 252 of the latch 34' in a similar manner as discussed above in relation to the twist insert 400. That is, in a first detent position, the ramp portion 502 of the keyed twist insert 500 does not engage the ramp portion 254 of the latch 34' (as depicted in FIG. 19), but when twisted up to 180-degrees to a second position, the ramp portion 502 engages the ramp portion 254 with a cam action to cause deflection of the latch 34' sufficient to disengage the latch 34' from the catch 40' so that the cover 22' can be opened relative to the back-housing 24'.

Similar to the twist insert 400, the keyed twist insert 500 includes a cylindrical body portion 504 configured to removably fit in the opening 32' of the cover 22', a flange portion 506 that engages with an outer surface of the cover 22' when the keyed twist insert 500 is disposed in the opening 32' of the cover 22', and flexible tabs 510, each having a snap-fit edge 512 that snap-fit engages with an underside surface of the cover 22' when the keyed twist insert 500 is fit into the opening 32' of the cover 22'.

Notably different from the twist insert 400 is the absence of an engagement portion 408 in the keyed twist insert 500. In place of an engagement portion 408, the keyed twist insert 500 includes an opening 508 (see FIGS. 17A, 17D and 17E) sized to receive the key device 92, which is configured to cooperate with the keyed twist insert 500 to serve a function similar to the function of the engagement portion 408 of the twist insert 400. That is, when the key device 92 is inserted into the opening 508 of the keyed twist insert 500, the key device 92 can be twisted by a user to cause the keyed twist insert 500 to rotate between a first position and a second position. As with the twist insert 400, when the keyed twist insert 500 is twisted up to 180-degrees from the first position to the second position, the ramp portion 502 engages the ramp portion 254 with a cam action to cause deflection of the latch 34' sufficient to disengage the latch 34' from the catch 40' so that the cover 22' can be opened relative to the back-housing 24'. The twist insert 400 and the keyed twist insert 500 are mutually interchangeable with each other. In this manner, a dispenser 20 may be equipped with either a twist insert 400 that permits any user to unlatch the cover 22', or a keyed twist insert 500 that permits only authorized personnel to unlatch the cover 22'.

In view of the above-described twist insert 400 and keyed twist insert 500, it will be appreciated that a twist-type insert for releasing a latched cover may be keyless (twist insert 400) or keyed (keyed twist insert 500 plus key device (92).

In comparing the embodiments of FIGS. 1-13 with the embodiments of FIGS. 14-21, it can be seen that different alternative embodiments are envisioned where the latch may be coupled to the cover or to the back-housing. Similarly, it will also be appreciated that the access device may also be coupled with the cover or with the back-housing. With consideration to the latter, an embodiment having an access device coupled to the back-housing will now be discussed with reference to FIGS. 22-23, where FIG. 22 depicts an embodiment of the dispenser 20 having a back-housing 24" and a cover 22" similar to those of the embodiments depicted in FIGS. 1-21, but where the back-housing 24" has a deeper profile with a depth "D" that provides an outer surface 600 for receiving an access device 28.

Figure 22:
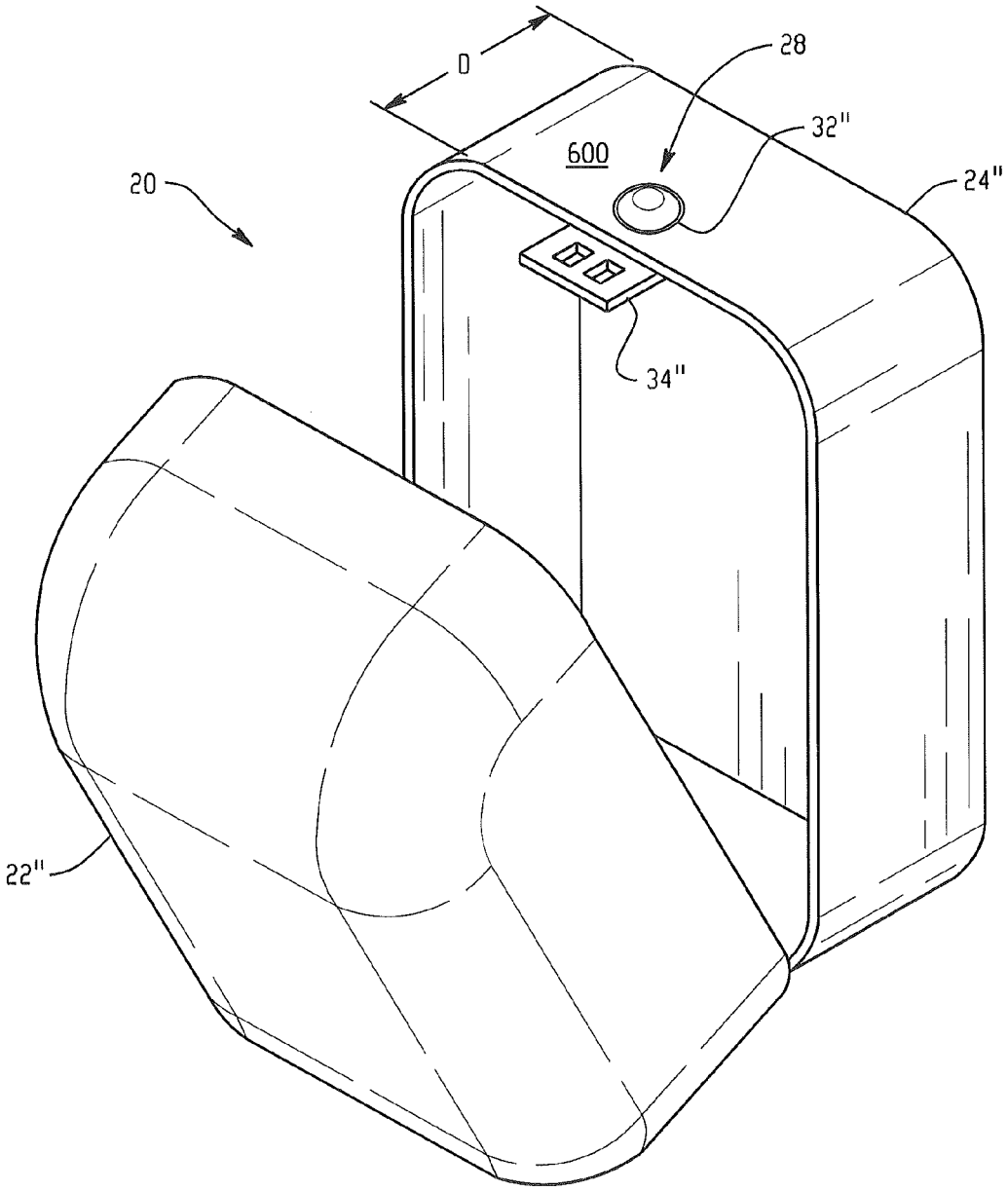
FIG. 22 is a perspective partial assembly view illustration of an alternative dispenser to that of FIG. 1 with the dispenser cover open, in accordance with an embodiment of the invention.
Figure 23:
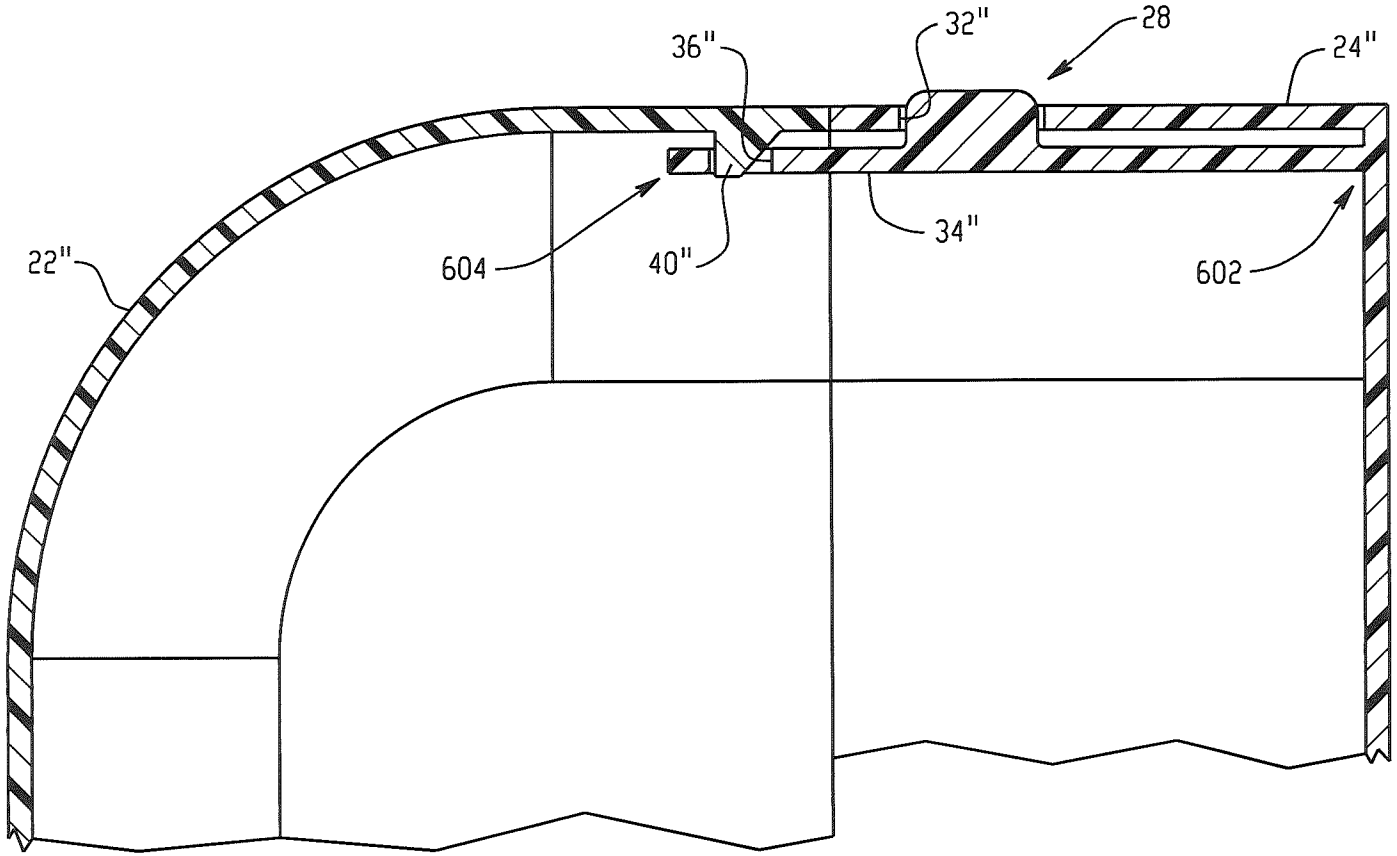
FIG. 23 is a partial schematic cross-section side view of an alternative dispenser latching scheme for the dispenser of FIG. 22 with the cover closed.

With reference now to FIG. 23, a schematic cross-section side view of the cover 22", back-housing 24", and access device 28 can be seen where the latch 34" is coupled to the back-housing 24". As with the embodiments of FIGS. 1-21, the latch 34" of FIGS. 22-23 is a cantilevered latch having a substantially fixed end 602 and a substantially flexible end 604. Toward the flexible end 604 there is an opening 36" (see opening 36 depicted in FIG. 2 for reference purposes) that provides a latching surface for a catch 40" that is arranged on the inside surface of the cover 22". As the cover 22" is closed onto the back-housing 24", a cam surface disposed on either the latch 34" or catch 40" causes the flexible end 604 of the latch 34" to deflect downwards (relative to the perspective of FIG. 23) until the catch 40" engages with the opening 36", at which time the latch 34" springs upward to securely engage the cover 22" in place relative to the back-housing 24".

To disengage the latch 34" from the catch 40", an access device 28 disposed in an opening 32" in the back-housing 24" is accessed by a user, which when pressed downward engages with the latch 34" causing the latch 34" to flexibly release itself from the catch 40".

From all of the foregoing discussions associated with FIGS. 1-21, it will be appreciated that the access device 28 of FIGS. 22-23 may be any of the foregoing access devices, including push-button device 50, keyed-device 66, rotary-tumbler device 68, key insert 200 with push-button insert 300, twist insert 400, keyed twist insert 500, or any other access device suitable for the purpose disclosed herein. Any and all such access devices are contemplated and considered within the scope of the invention disclosed herein.

Figure 24:
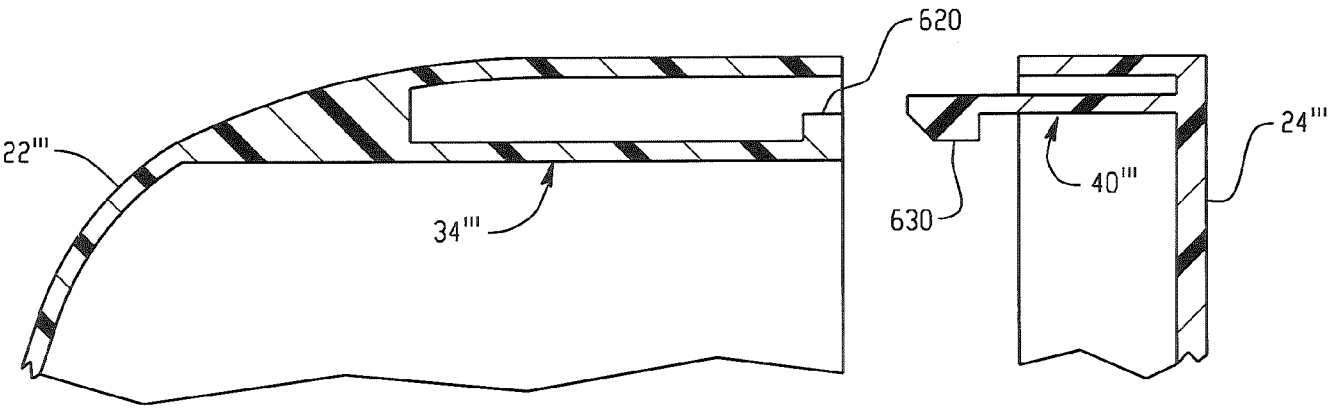
FIG. 24 is a partial schematic cross-section side view of an alternative dispenser latching scheme to that depicted in FIG. 23 with the cover open.
Figure 25:
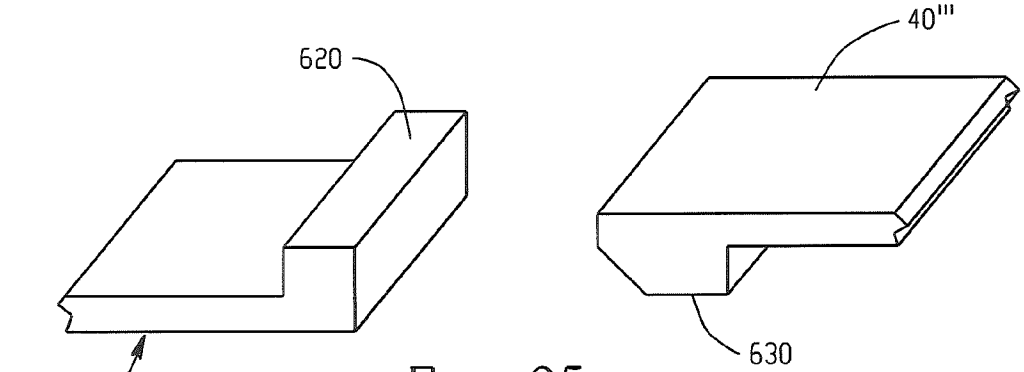
FIG. 25 is a partial perspective view of portions of the latching scheme depicted in FIG. 24.

With reference now to FIGS. 24-25, it will be appreciated that while discussions above have referred to the latch member 34 of FIG. 2 and the latch member 34" of FIG. 23 having one or more holes 36, 36" that engage with projection portions of the catch 40, 40", other means of securing the top of the dispenser against the back-housing when the cover is in the closed position are contemplated. For example, a stepped latch 34''' having an engagement step 620 that is coupled to the cover 22''' may engage a similarly stepped catch 40''' having an engagement step 630 that is coupled to the back-housing 24'''. The arrangement of latch 34''' and catch 40''' depicted in FIGS. 24-25 is similar to the latch 34' and catch 40' depicted in FIGS. 16 and 19, but with slightly different profiles and degree of flexibility associated with the catch. As such, any latch and catch arrangement suitable for the purpose disclosed herein is contemplated and is considered within the scope of the invention disclosed herein.

A dispenser having interchangeable access devices 28 described herein provide a number of advantages to the manufacturer and installer of dispenser 20. By providing a fast and convenient means of changing the type of access device 28 used, the dispenser 20 reduces inventory requirements for the manufacturer and installer since only one common model of dispenser 20 needs to be stocked. The dispenser 20 also allows late point identification by the installer, or the operator, on what level of security is desired for a given application. The dispenser 20 further allows the level of security to be changed at a later date if the application or the operator so desired.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, front, rear, top, bottom etc. do not denote any orientation, order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A dispenser comprising:

a back-housing;

a latch coupled to the back-housing;

a cover movably coupled to the back-housing, the cover having an opening;

a catch coupled to the cover, the latch cooperating with the catch to hold the cover against the back-housing when the cover is in a first position;

a key insert disposed to be removably coupled to the opening of the cover;

a push button insert disposed to be removably coupled to the key insert; and a key device disposed to be removably coupled to the key insert;

wherein the push button insert and the key device are mutually interchangeable with each other for being removably coupled to the key insert by a user.

2. The dispenser of claim 1 wherein the push button insert when disposed in the key insert cooperates with the latch to disengage the latch from the catch when the push button insert is moved from a first position to a second position.

3. The dispenser of claim 2 wherein the key insert further includes an opening sized to receive the key device, wherein the key device cooperates with the latch to disengage the latch from the catch when the key device is inserted in the opening of the key insert.

4. The dispenser of claim 2 wherein the cover is arranged to move from the first position to a second position when the latch is disengaged from the catch.

5. The dispenser of claim 2 wherein the push button insert includes a flexible tab having a snap-fit edge that snap-fit engages with the key insert, wherein the push button insert is in its first position when the snap-fit edge is in contact with the key insert.

6. The dispenser of claim 1 wherein the key insert includes a flexible tab having a snap-fit edge that snap-fit engages with the cover.

7. The dispenser of claim 1 wherein the cover includes a first alignment feature and the key insert includes a second alignment feature, wherein the second alignment feature of the key insert is disposed to mate with the first alignment feature of the cover when the key insert is positioned in the opening of the cover.

8. The dispenser of claim 7 wherein the first alignment feature comprises a slot, and the second alignment feature comprises a rib.

9. The dispenser of claim 3 wherein the opening of the key insert is bifurcated into a first opening sized to receive a first portion of the key device, and a second opening sized to receive a second portion of the key device, wherein the key device first portion and the key device second portion are arranged to cooperate with the latch to disengage the latch from the catch.

10. The dispenser of claim 3 wherein the push button insert further includes a leg portion sized to fit in the opening of the key insert, wherein the leg portion cooperates with the latch to disengage the latch from the catch when the push button insert is moved from a first push button insert position to a second push button insert position.

11. The dispenser of claim 10 wherein the opening of the key insert is bifurcated into a first opening sized to receive a first leg portion of the push button insert, and a second opening sized to receive a second leg portion of the push button insert, wherein the first leg portion and the second leg portion are arranged to cooperate with the latch to disengage the latch from the catch.

12. The dispenser of claim 1, further comprising a twist insert disposed to be removably coupled to the opening of the cover, wherein the twist insert and the key insert are mutually interchangeable with each other for being removably coupled to the cover by a user, wherein the twist insert cooperates with the latch to disengage the latch from the catch when the twist insert is twisted from a first position to a second position.

13. The dispenser of claim 12, wherein the twist insert comprises:

a cylindrical body portion configured to removably fit in the opening of the cover;

a flange portion configured to engage with an outer surface of the cover when the twist insert is disposed in the opening of the cover; and an engagement portion disposed to be accessible to a user when the twist insert is disposed in the opening of the cover.

14. The dispenser of claim 13, wherein the twist insert further comprises:

a flexible tab having a snap-fit edge that snap-fit engages with the cover when the twist insert is fit in the opening of the cover.

15. The dispenser of claim 13, wherein the twist insert further comprises a ramp portion that cooperates with the latch to disengage the latch from the catch when the twist insert is disposed in the opening of the cover and when the twist insert is twisted from a first position to a second position.

16. The dispenser of claim 15, wherein the engagement portion comprises a projection that extends at least partially across the twist insert, the projection being configured to be accessible by a user's fingers for twisting the twist insert from the first position to the second position.

17. The dispenser of claim 12, wherein the twist insert is a keyed twist insert comprising an opening sized to receive the key device, wherein the key device cooperates with the keyed twist insert to disengage the latch from the catch when the key device is inserted in the opening of the keyed twist insert and is used to turn the keyed twist insert from a first position to a second position.

18. The dispenser of claim 17, wherein the opening of the keyed twist insert comprises a first opening sized to receive a first portion of the key device, and a second opening sized to receive a second portion of the key device, wherein the key device first portion and the key device second portion are arranged to cooperate with edges of the opening of the keyed twist insert to disengage the latch from the catch when the key device is used to turn the keyed twist insert from the first position to the second position.

19. A dispenser comprising:

a back-housing;

a latch coupled to the back-housing;

a cover movably coupled to the back-housing, the cover having an opening;

a catch coupled to the cover, the latch cooperating with the catch to hold the cover against the back-housing when the cover is in a first position;

at least one of: a key insert disposed to be removably coupled to the opening of the cover;

a push button insert disposed to be removably coupled to the key insert; a twist insert disposed to be removably coupled to the opening of the cover; and, a keyed twist insert disposed to be removably coupled to the opening of the cover; and a key device disposed to be removably coupled to the key insert and the keyed twist insert;

wherein the push button insert and the key device are mutually interchangeable with each other for being removably coupled to the key insert by a user, and wherein the twist insert and the keyed twist insert are mutually interchangeable with each other for being removably coupled to the cover.

20. A dispenser comprising:

a back-housing comprising an opening;

a latch coupled to the back-housing;

a cover movably coupled to the back-housing;

a catch coupled to the cover, the latch cooperating with the catch to hold the cover against the back-housing when the cover is in a first position;

a key insert disposed to be removably coupled to the opening of the back-housing;

a push button insert disposed to be removably coupled to the key insert; and a key device disposed to be removably coupled to the key insert;

wherein the push button insert and the key device are mutually interchangeable with each other for being removably coupled to the key insert by a user.

* * * * *